US010415861B2

(12) United States Patent
Takenaka et al.

(10) Patent No.: US 10,415,861 B2
(45) Date of Patent: Sep. 17, 2019

(54) REFRIGERATION CYCLE APPARATUS

(71) Applicant: Mitsubishi Electric Corporation, Chiyoda-ku (JP)

(72) Inventors: Naofumi Takenaka, Chiyoda-ku (JP); Shinichi Wakamoto, Chiyoda-ku (JP); Kazuya Watanabe, Chiyoda-ku (JP); Naomichi Tamura, Chiyoda-ku (JP); Tadashi Ariyama, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 182 days.

(21) Appl. No.: 15/571,393

(22) PCT Filed: Mar. 28, 2016

(86) PCT No.: PCT/JP2016/059861
§ 371 (c)(1),
(2) Date: Nov. 2, 2017

(87) PCT Pub. No.: WO2017/006596
PCT Pub. Date: Jan. 12, 2017

(65) Prior Publication Data

US 2019/0154321 A1 May 23, 2019

(30) Foreign Application Priority Data

Jul. 6, 2015 (JP) ..... 2015-135038

(51) Int. Cl.
*F25B 5/02* (2006.01)
*F25B 47/02* (2006.01)
(Continued)

(52) U.S. Cl.
CPC ..... *F25B 47/025* (2013.01); *F24F 11/89* (2018.01); *F25B 5/02* (2013.01); *F25B 13/00* (2013.01);
(Continued)

(58) Field of Classification Search
CPC ..... F25B 13/00; F25B 2313/0233; F25B 2313/0251; F25B 2313/0253;
(Continued)

(56) References Cited

U.S. PATENT DOCUMENTS 4,850,204 A * 7/1989 Bos ..... F25B 47/025 62/234
4,884,414 A * 12/1989 Bos ..... F25D 21/006 62/156
8,656,729 B2 * 2/2014 Matsuoka ..... F24F 3/001 62/324.1
(Continued)

FOREIGN PATENT DOCUMENTS

WO 2012/014345 A1 2/2012
WO 2014/083867 A1 6/2014

OTHER PUBLICATIONS

International Search Report dated Jun. 21, 2016, in PCT/JP2016/059861, filed Mar. 28, 2016.

*Primary Examiner* — Filip Zec
(74) *Attorney, Agent, or Firm* — Oblon, McClelland, Maier & Neustadt, L.L.P.

(57) ABSTRACT

A controller switches between and performs a first simultaneous heating and defrosting operation of supplying part of refrigerant discharged from a compressor is supplied to one or some parallel heat exchangers among a plurality of parallel heat exchangers through a defrosting circuit and allowing the other one or more parallel heat exchangers to operate as evaporators, and a second simultaneous heating and defrosting operation of, in one or some heat source units among a plurality of heat source units, supplying the refrigerant discharged from the compressor is supplied to all the plurality of parallel heat exchangers through the defrosting circuit, and in the other one or more heat source units, continuing heating by allowing all the plurality of parallel heat exchangers to operate as evaporators.

10 Claims, 23 Drawing Sheets

(51) Int. Cl.

| | |
|---|---|
| ***F25B 13/00*** | (2006.01) |
| ***F24F 11/89*** | (2018.01) |
| ***F25B 49/02*** | (2006.01) |
| ***F25D 21/00*** | (2006.01) |

(52) U.S. Cl.
CPC ..... *F25B 47/02* (2013.01); *F25B 47/022* (2013.01); *F25B 49/02* (2013.01); *F25D 21/006* (2013.01); *F25B 2313/0233* (2013.01); *F25B 2313/0251* (2013.01); *F25B 2313/0253* (2013.01); *F25B 2400/0403* (2013.01); *F25B 2400/0411* (2013.01); *F25B 2400/121* (2013.01); *F25B 2700/1931* (2013.01); *F25B 2700/1933* (2013.01); *F25B 2700/2106* (2013.01)

(58) Field of Classification Search
CPC ..... F25B 2400/0403; F25B 2400/0411; F25B 2400/121; F25B 2700/1931; F25B 2700/1933; F25B 2700/2106; F25B 47/02; F25B 47/022; F25B 47/025; F25B 49/02; F25B 5/02; F24F 11/89; F25D 21/006
See application file for complete search history.

(56) References Cited

U.S. PATENT DOCUMENTS

| | | | | |
|---|---|---|---|---|
| 9,285,802 | B2 * | 3/2016 | Arensmeier ..... | G05B 23/0224 |
| 9,797,648 | B2 * | 10/2017 | Ishikawa ..... | F25B 13/00 |
| 2013/0098092 | A1 | 4/2013 | Wakamoto et al. | |
| 2015/0292789 | A1 | 10/2015 | Takenaka et al. | |

* cited by examiner

FIG. 5

| | VALVE NUMBER | COOLING | HEATING | | | |
|---|---|---|---|---|---|---|
| | | | NORMAL OPERATION | REVERSE DEFROSTING | SIMULTANEOUS HEATING AND DE-FROSTING OPERATION 1 (e.g.) 50-11, 50-12: EVAPORATOR 50-21, 50-22: DEFROSTING | SIMULTANEOUS HEATING AND DE-FROSTING OPERATION 2 (e.g.) 50-11, 50-12: EVAPORATOR 50-21, 50-22: DEFROSTING |
| A-1 | 2-1 | OFF | ON | OFF | ON | ON |
| | 7-11 | FULLY OPENED | FULLY OPENED | FULLY OPENED | FULLY OPENED | FULLY OPENED |
| | 7-12 | FULLY OPENED | FULLY OPENED | FULLY OPENED | FULLY CLOSED | FULLY OPENED |
| | 7-13 | OFF | OFF | OFF | DEFROSTING HEAT EXCHANGE PRESSURE | OFF |
| | 8-11 | ON | ON | ON | ON | ON |
| | 8-12 | ON | ON | ON | OFF | ON |
| | 9-11 | OFF | OFF | OFF | OFF | OFF |
| | 9-12 | OFF | OFF | OFF | ON | OFF |
| | 10-1 | CLOSED | CLOSED | CLOSED | FIXED OPENING DEGREE | CLOSED |
| A-2 | 2-2 | OFF | ON | OFF | ON | ON |
| | 7-21 | FULLY OPENED | FULLY OPENED | FULLY OPENED | FULLY OPENED | FULLY CLOSED |
| | 7-22 | FULLY OPENED | FULLY OPENED | FULLY OPENED | FULLY CLOSED | FULLY CLOSED |
| | 7-23 | OFF | OFF | OFF | DEFROSTING HEAT EXCHANGE PRESSURE | FULLY OPENED |
| | 8-21 | ON | ON | ON | ON | OFF |
| | 8-22 | ON | ON | ON | OFF | ON |
| | 9-21 | OFF | OFF | OFF | OFF | ON |
| | 9-22 | OFF | OFF | OFF | ON | OFF |
| | 10-2 | CLOSED | CLOSED | CLOSED | FIXED OPENING DEGREE | DISCHARGE PRESSURE |
| B,C | 4-b, 4-c | REFRIGERANT SUPERHEAT AT OUTLET OF INDOOR UNIT | REFRIGERANT SUBCOOLING AT OUTLET OF INDOOR UNIT | FULLY OPENED | REFRIGERANT SUBCOOLING AT OUTLET OF INDOOR UNIT | REFRIGERANT SUBCOOLING AT OUTLET OF INDOOR UNIT |

REFRIGERATION CYCLE APPARATUS

TECHNICAL FIELD

The present invention relates to a refrigeration cycle apparatus which is to be used for, for example, an air-conditioning apparatus.

BACKGROUND ART

In Patent Literature 1, there is described an air-conditioning apparatus including a defrosting pipe, an expansion device, and a connection switching device. The defrosting pipe branches part of refrigerant discharged from a compressor and allows the branched refrigerant to flow into a selected parallel heat exchanger subjected to defrosting among a plurality of parallel heat exchangers. The expansion device is provided in the defrosting pipe, and is configured to decompress the refrigerant discharged from the compressor. The connection switching device allows the refrigerant having flowed out of the parallel heat exchanger subjected to defrosting to flow into a main circuit on an upstream side of the parallel heat exchangers other than the parallel heat exchanger subjected to defrosting.

CITATION LIST

Patent Literature

Patent Literature 1: International Patent Publication No. WO 2014/083867

SUMMARY OF INVENTION

Technical Problem

The air-conditioning apparatus described in Patent Literature 1 is capable of performing a simultaneous heating and defrosting operation. In the simultaneous heating and defrosting operation, a parallel heat exchanger subjected to defrosting is defrosted while a heating operation is continued by allowing parallel heat exchangers other than the parallel heat exchanger subjected to defrosting to operate as evaporators. However, in the simultaneous heating and defrosting operation, it is necessary that heat from outdoor air be received by the parallel heat exchangers other than the parallel heat exchanger subjected to defrosting, and thus it is necessary to operate an outdoor fan. The outdoor air sent by the outdoor fan also flows into the parallel heat exchanger subjected to defrosting. Accordingly, particularly when an outdoor air temperature decreases, an amount of heat transferred from the parallel heat exchanger subjected to defrosting to the outdoor air increases. Therefore, there is a problem in that the heating capacity of the air-conditioning apparatus may decrease.

The present invention has been made to solve the above-described problem, and has an object to provide a refrigeration cycle apparatus capable of suppressing a decrease in heating capacity in a simultaneous heating and defrosting operation.

Solution to Problem

According to one embodiment of the present invention, there is provided a refrigeration cycle apparatus including a main circuit configured to circulate refrigerant; a plurality of heat source units connected in parallel to each other in the main circuit; and a controller configured to control the plurality of heat source units, each of the plurality of heat source units including: a compressor configured to compress and discharge refrigerant; a plurality of parallel heat exchangers connected in parallel to each other in a flow of refrigerant and configured to operate at least as evaporators; a check valve configured to prevent backflow of the refrigerant discharged from the compressor; a defrosting circuit configured to branch the refrigerant discharged from the compressor on an upstream side of the check valve and supply the refrigerant to at least one or some parallel heat exchangers among the plurality of parallel heat exchangers; and a first flow switching device configured to switch a flow passage of refrigerant passing through the plurality of parallel heat exchangers, wherein the controller is configured to switch between and perform a first simultaneous heating and defrosting operation of, in at least one or some heat source units among the plurality of heat source units, supplying part of the refrigerant discharged from the compressor to the one or some parallel heat exchangers among the plurality of parallel heat exchangers through the defrosting circuit and allowing the other one or more parallel heat exchangers among the plurality of parallel heat exchangers to operate as evaporators, and a second simultaneous heating and defrosting operation of, in one or some heat source units among the plurality of heat source units, supplying the refrigerant discharged from the compressor to all the plurality of parallel heat exchangers through the defrosting circuit, and in the other one or more heat source units among the plurality of heat source units, continuing heating by allowing all the plurality of parallel heat exchangers to operate as evaporators, and operating the plurality of the heat source units so that a suction pressure of the compressor in each of the one or some heat source units among the plurality of heat source units is higher than a suction pressure of the compressor in each of the other one or more heat source units among the plurality of heat source units.

Advantageous Effects of Invention

According to one embodiment of the present invention, a defrosting method enabling a high heating capacity can be selected, and thus the decrease in heating capacity in the simultaneous heating and defrosting operation can be suppressed.

BRIEF DESCRIPTION OF DRAWINGS

FIG. 5 is a diagram for illustrating an example of states of valves in operation modes of the air-conditioning apparatus 100 of Embodiment 1 of the present invention.

DESCRIPTION OF EMBODIMENTS

Figure 1:
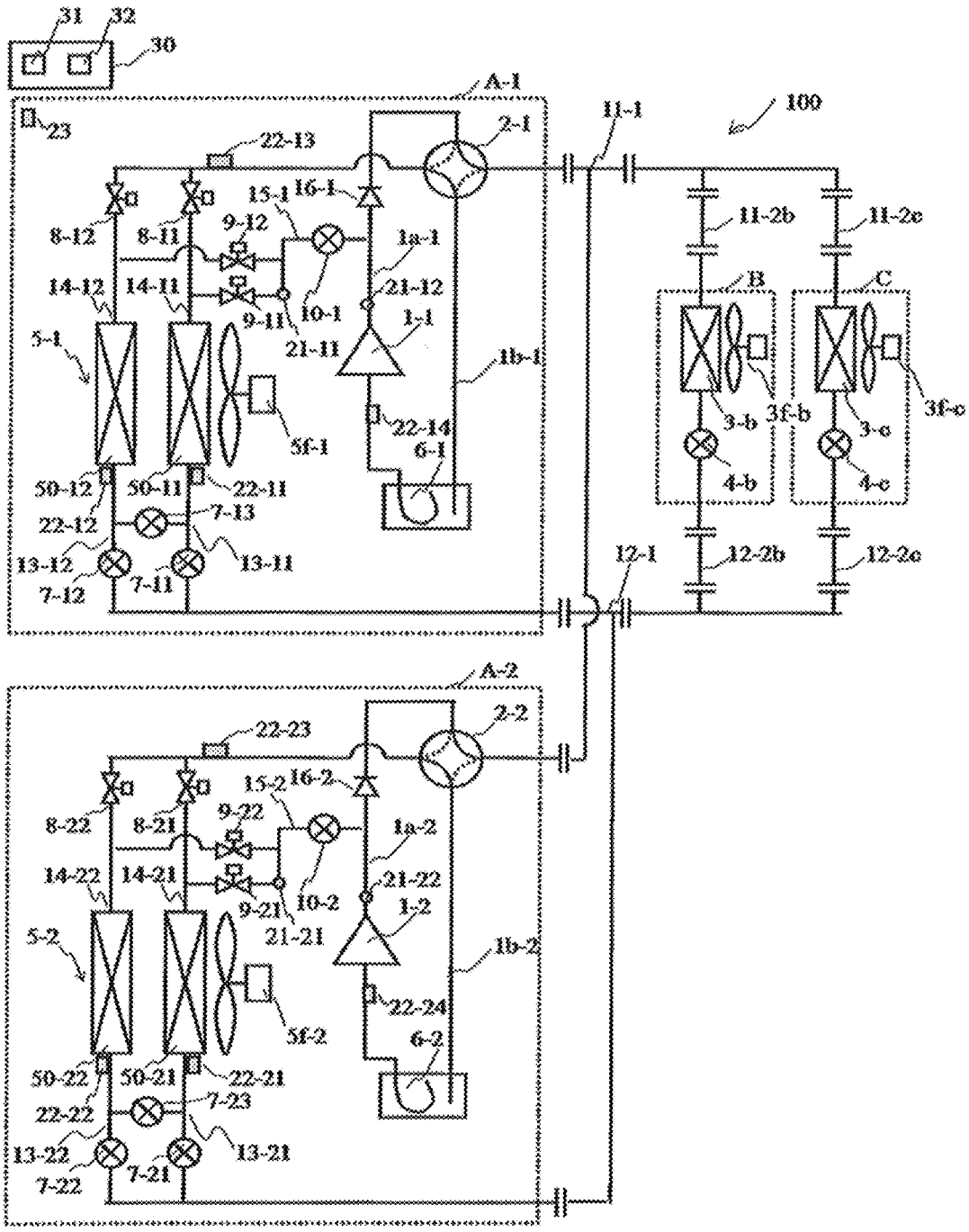
FIG. 1 is a circuit configuration diagram for illustrating the configuration of an air-conditioning apparatus 100 of Embodiment 1 of the present invention.

Now, a refrigeration cycle apparatus according to embodiments of the present invention is described with reference to the drawings, while an air-conditioning apparatus including the refrigeration cycle apparatus is exemplified. In the drawings including FIG. 1, components denoted by the same reference signs are the same or correspond to each other, and this is applied throughout the text of the description. In addition, the modes of components described throughout the text of the description are merely examples, and the components are not limited to those modes. Also, combinations of components are not limited to only combinations in the embodiments. The components described in the embodiments can be applied to another embodiment. In addition, a plurality of components of the same type that are distinguished from each other by using suffixes or branch numbers may be described without using the suffixes or branch numbers unless otherwise distinguished or specified. In the drawings, dimensional relationships among the components may be different from actual dimensional relationships. In addition, high or low in temperature, pressure, and other parameters is not particularly determined in relation to an absolute value, but is relatively determined in accordance with a state or operation of a system, an apparatus, or other conditions.

Embodiment 1

An air-conditioning apparatus of Embodiment 1 of the present invention is described. FIG. 1 is a circuit configuration diagram for illustrating the configuration of an air-conditioning apparatus 100 of Embodiment 1. As illustrated in FIG. 1, the air-conditioning apparatus 100 includes a plurality of heat source units A-1 and A-2 (heat-source-side units) connected in parallel to each other in a refrigerant circuit and a plurality of indoor units B and C (use-side units) connected in parallel to each other in the refrigerant circuit. The heat source units A-1 and A-2 are installed outdoors, for example, and the indoor units B and C are installed indoors, for example. The heat source units A-1 and A-2 are connected to the indoor unit B through first extension pipes 11-1 and 11-2*b* and second extension pipes 12-1 and 12-2*b*. The heat source units A-1 and A-2 are connected to the indoor unit C through first extension pipes 11-1 and 11-2*c* and second extension pipes 12-1 and 12-2*c*. A set of the heat source units A-1 and A-2 and a set of the indoor units B and C are circularly connected to each other through the first extension pipes 11-1, 11-2*b*, and 11-2*c* and the second extension pipes 12-1, 12-2*b*, and 12-2*c*, or other pipes. Accordingly, a main circuit of the refrigerant circuit is formed.

The air-conditioning apparatus 100 further includes a controller 30. The controller 30 has a function of switching operation modes by controlling cooling/heating switching devices 2-1 and 2-2, a defrosting circuit, which are described later, and other components. The operation modes of the air-conditioning apparatus 100 include at least a cooling operation and a heating operation. The heating operation includes, as sub operation modes, a normal heating operation, a reverse defrosting operation, a first simultaneous heating and defrosting operation (hereinafter sometimes referred to as "simultaneous heating and defrosting operation 1"), and a second simultaneous heating and defrosting operation (hereinafter sometimes referred to as "simultaneous heating and defrosting operation 2").

The controller 30 includes a selecting unit 31 and a determining unit 32. The selecting unit 31 selects any one of the first simultaneous heating and defrosting operation and the second simultaneous heating and defrosting operation as an operation mode in the case of performing a defrosting operation. The determining unit 32 determines whether or not to perform a defrosting operation. The controller 30 includes, for example, a control operation processing unit, such as a central processing unit (CPU), and a storage unit that stores data of a program of a processing procedure related to control and other operations. The selecting unit 31 and the determining unit 32 of Embodiment 1 are functional blocks that are implemented when the control operation processing unit executes the program stored in the storage unit. For example, the selecting unit 31 is a functional block, which corresponds to Step S6 in FIG. 4, and is described below, and the determining unit 32 is a functional block corresponding to Step S5 in FIG. 4.

As refrigerant that is allowed to circulate through the refrigerant circuit, a fluorocarbon refrigerant, an HFO refrigerant, or other refrigerants can be used. Examples of the fluorocarbon refrigerant include R32, R125, and R134a, which are HFC-based refrigerants. Examples of the fluorocarbon refrigerant also include R410A, R407C, and R404A, which are mixtures of HFC-based refrigerants. Examples of the HFO refrigerant include HFO-1234yf, HFO-1234ze (E), HFO-1234ze (Z), and HFO-1123. Furthermore, other various kinds of refrigerants for use in a vapor-compression-type heat pump circuit, such as a $CO_2$ refrigerant, an HC refrigerant (for example, propane or an isobutene refrigerant), an ammonia refrigerant, and a mixture of the foregoing refrigerants such as a mixture of R32 and HFO-1234yf, can be used.

In Embodiment 1, description is made of, as an example, the refrigerant circuit in which the two heat source units A-1 and A-2 are connected to the two indoor units B and C, but the number of heat source units and indoor units connected to each other is not limited thereto. In the refrigerant circuit, one indoor unit or three or more indoor units may be connected, and three or more heat source units may be connected in parallel. In addition, three extension pipes may be connected in parallel, or a switching valve may be provided on an indoor unit side, thereby forming a refrigerant circuit configuration that enables a simultaneous cooling and heating operation in which each indoor unit independently selects cooling or heating.

Next, the configuration of the refrigerant circuit in the air-conditioning apparatus 100 of Embodiment 1 is described. Here, the heat source units A-1 and A-2 are connected in parallel to each other in the refrigerant circuit, and the refrigerant circuit in the heat source unit A-1 and the refrigerant circuit in the heat source unit A-2 have the same configuration. Thus, the configuration of the refrigerant circuit including only the heat source unit A-1 of the heat source units A-1 and A-2 is described first, and then the heat source unit A-2 is briefly described.

The refrigerant circuit of the air-conditioning apparatus 100 includes a main circuit in which a compressor 1-1, the cooling/heating switching device 2-1, indoor heat exchangers 3-*b* and 3-*c*, flow rate control devices 4-*b* and 4-*c* corresponding to the indoor heat exchangers 3-*b* and 3-*c*, and an outdoor heat exchanger 5-1 are sequentially connected through refrigerant pipes. In addition, the refrigerant circuit of Embodiment 1 is further provided with an accumulator 6-1. The accumulator 6-1 is located at a suction portion of the compressor 1-1. The accumulator 6-1 has a refrigerant accumulation function of accumulating surplus refrigerant, such as a difference between an amount of refrigerant required for cooling and an amount of refrigerant required for heating. In addition, the accumulator 6-1 has a gas-liquid separation function of separating incoming refrigerant into liquid refrigerant and gas refrigerant and allowing only the gas refrigerant to flow out. However, the accumulator 6-1 is not an essential component. For example, a container for accumulating liquid refrigerant may be connected to a portion other than the suction portion of the compressor 1-1 in the refrigerant circuit.

The indoor unit B accommodates the indoor heat exchanger 3-*b*, the flow rate control device 4-*b*, and an indoor fan 3*f*-*b* for sending air to the indoor heat exchanger 3-*b*. The indoor unit C accommodates the indoor heat exchanger 3-*c*, the flow rate control device 4-*c*, and an indoor fan 3*f*-*c* for sending air to the indoor heat exchanger 3-*c*.

The indoor heat exchangers 3-*b* and 3-*c* exchange heat between refrigerant circulating inside and indoor air sent by the indoor fans 3*f*-*b* and 3*f*-*c*. For example, during the cooling operation, the indoor heat exchangers 3-*b* and 3-*c* operate as evaporators to receive evaporation heat of refrigerant from indoor air and to vaporize the refrigerant. During the heating operation, the indoor heat exchangers 3-*b* and 3-*c* operate as condensers (or radiators) to transfer condensation heat of refrigerant to indoor air and to liquefy the refrigerant.

The indoor fans 3*f*-*b* and 3*f*-*c* suck indoor air, allow the air to pass through the indoor heat exchangers 3-*b* and 3-*c*, respectively, and generate flows of air to be sent into a room again.

The flow rate control devices 4-*b* and 4-*c* are each formed of, for example, an electronic expansion valve capable of controlling a flow rate of refrigerant in a continuous or multistage manner by adjusting an opening degree. The flow rate control devices 4-*b* and 4-*c* change their opening degrees in response to an instruction from the controller 30, thereby adjusting, for example, the pressure and temperature of refrigerant in the indoor heat exchangers 3-*b* and 3-*c*.

The heat source unit A-1 accommodates the compressor 1-1, the cooling/heating switching device 2-1, the outdoor heat exchanger 5-1, the accumulator 6-1, and an outdoor fan 5*f*-1 for sending outdoor air to the outdoor heat exchanger 5-1.

The compressor 1-1 is a fluid machine that compresses and discharges sucked refrigerant. Here, although not particularly limited, the compressor 1-1 may be configured so that the capacity (an amount of refrigerant discharged per unit time) of the compressor 1-1 is changed by changing a driving frequency in a freely selectable manner, by using, for example, an inverter circuit.

The cooling/heating switching device 2-1 switches the flow passage of the refrigerant discharged from the compressor 1-1. The cooling/heating switching device 2-1 is formed of, for example, a four-way valve. The cooling/heating switching device 2-1 is connected between a discharge pipe 1*a*-1 that is connected on a discharge side of the compressor 1-1 and a suction pipe 1*b*-1 that is connected on a suction side of the compressor 1-1. The cooling/heating switching device 2-1 is controlled by the controller 30. During the heating operation, the controller 30 switches the flow passage of the cooling/heating switching device 2-1 as indicated by a solid line in FIG. 1 so that the refrigerant discharged from the compressor 1-1 flows into the indoor heat exchanges 3-*b* and 3-*c*. During the cooling operation, the controller 30 switches the flow passage of the cooling/heating switching device 2-1 as indicated by a dotted line in FIG. 1 so that the refrigerant discharged from the compressor 1-1 flows into the outdoor heat exchanger 5-1.

The outdoor heat exchanger 5-1 exchanges heat between refrigerant circulating inside and outdoor air sent by the outdoor fan 5*f*-1. For example, during the cooling operation, the outdoor heat exchanger 5-1 operates as a condenser (or radiator) to transfer condensation heat of refrigerant to outdoor air and to liquefy the refrigerant. During the heating operation, the outdoor heat exchanger 5-1 operates as an evaporator to receive evaporation heat of refrigerant from outdoor air and to vaporize the refrigerant.

The outdoor fan **5*f*-1 sends outdoor air to the outdoor heat exchanger 5-1**.

Figure 2:
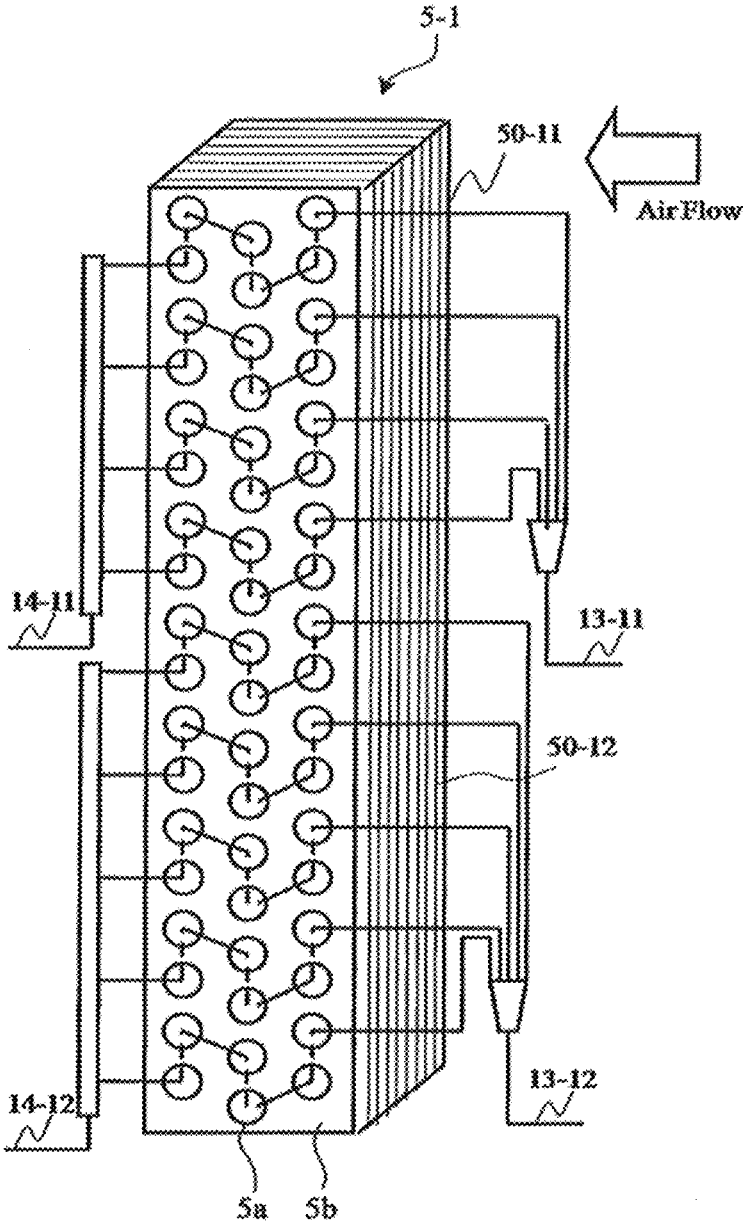
FIG. 2 is a diagram for illustrating an example configuration of an outdoor heat exchanger 5-1 of Embodiment 1 of the present invention.

FIG. 2 is a diagram for illustrating an example configuration of the outdoor heat exchanger 5-1 of Embodiment 1. As illustrated in FIG. 2, the outdoor heat exchanger 5-1 is, for example, a fin-and-tube heat exchanger with a cross-fin design including a plurality of heat transfer tubes **5*a* and a plurality of fins 5*b*. The outdoor heat exchanger 5-1 includes a plurality of parallel heat exchangers. In this example, a configuration is illustrated in which the outdoor heat exchanger 5-1 includes two parallel heat exchangers 50-11 and 50-12. The parallel heat exchanger 50-11 is located in an upper part of the outdoor heat exchanger 5-1, and the parallel heat exchanger 50-12 is located below the parallel heat exchanger 50-11**.

Each heat transfer tube **5*a* allows refrigerant to pass therethrough. A plurality of heat transfer tubes 5*a* are provided in a column direction (the up-down direction in FIG. 2) vertical to an air flow direction (the direction indicated by an empty arrow in FIG. 2) and in a row direction (the right-left direction in FIG. 2) parallel to the air flow direction. The fins 5*b*** are arranged at intervals to allow passage of air.

The outdoor heat exchanger 5-1 includes the two parallel heat exchangers 50-11 and 50-12 arranged in the up-down direction. The parallel heat exchangers 50-11 and 50-12 are provided in parallel to each other in a flow of refrigerant and are provided in parallel to each other also in a flow of air. In the configuration illustrated in FIG. 2, the heat transfer tubes **5*a* on an upwind side are connected to first connection pipes 13-11 and 13-12 (connection pipes that allow refrigerant to flow into the outdoor heat exchanger 5-1 during the heating operation), and the heat transfer tubes 5*a* on a downwind side are connected to second connection pipes 14-11 and 14-12 (connection pipes that allow refrigerant to flow out of the outdoor heat exchanger 5-1 during the heating operation). Alternatively, the heat transfer tubes 5*a* on the upwind side may be connected to the second connection pipes 14-11 and 14-12, and the heat transfer tubes 5*a* on the downwind side may be connected to the first connection pipes 13-11 and 13-12. As is described below, when one or both of the parallel heat exchangers 50-11 and 50-12 are to be defrosted, refrigerant may flow from the second connection pipe 14 (the second connection pipe 14-11 or the second connection pipe 14-12) into the parallel heat exchanger to be defrosted, and the refrigerant may flow out of the parallel heat exchanger to the first connection pipe 13 (the first connection pipe 13-11 or the first connection pipe 13-12). Thus, as a result of connecting the heat transfer tubes 5*a* on the upwind side to the second connection pipes 14-11 and 14-12 and connecting the heat transfer tubes 5*a* on the downwind side to the first connection pipes 13-11 and 13-12**, the heat transferred to air on the upwind side at the time of defrosting can be used for defrosting on the downwind side.

Figure 3:
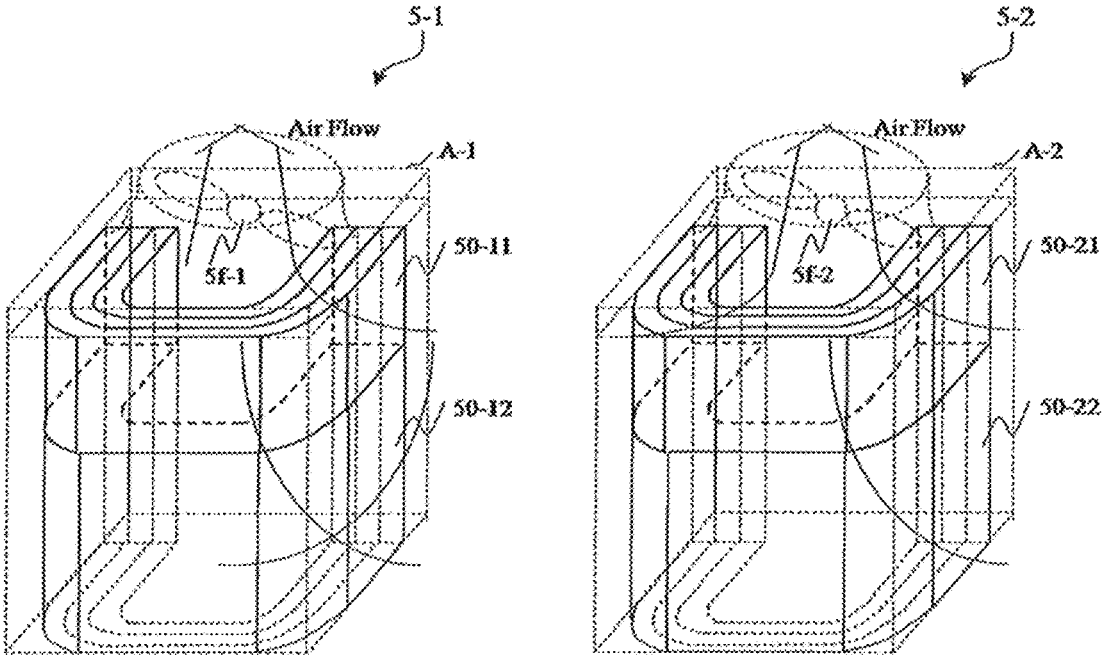
FIG. 3 is a diagram for illustrating an example in which outdoor heat exchangers 5-1 and 5-2 are mounted in heat source units A-1 and A-2 of Embodiment 1 of the present invention.

FIG. 3 is a diagram for illustrating an example in which the outdoor heat exchangers 5-1 and 5-2 are mounted in the heat source units A-1 and A-2 of Embodiment 1. As illustrated in FIG. 3, the outdoor heat exchanger 5-1 (the parallel heat exchangers 50-11 and 50-12) and the outdoor heat exchanger 5-2 (parallel heat exchangers 50-21 and 50-22) are mounted in the heat source units A-1 and A-2, respectively. Each of the heat source units A-1 and A-2 is of a top-flow type, in which outdoor air is allowed to flow thereinto from a side surface of a housing and the outdoor air having passed through the outdoor heat exchangers 5-1 and 5-2 is allowed to flow out from an upper surface of the housing. In the case of the heat source units A-1 and A-2 of a top-flow type, the wind speed is higher in an upper part than in a lower part. Thus, the heat transfer areas of the parallel heat exchangers 50-12 and 50-22 located in the lower part may be larger than the heat transfer areas of the parallel heat exchangers 50-11 and 50-21 located in the upper part so that AK values of the parallel heat exchangers 50-11 and 50-12 are equal to each other as much as possible and that AK values of the parallel heat exchangers 50-21 and 50-22 are equal to each other as much as possible. Here, an AK value is the product of a heat transfer area and a heat transmission coefficient of a heat exchanger, and is a value [kW/K] indicating the ability of a heat transmission coefficient per unit temperature.

The plurality of fins **5*b* need not be separated between the parallel heat exchanger 50-11 side and the parallel heat exchanger 50-12 side, or may be thermally separated so that each of the parallel heat exchangers 50-11 and 50-12 has independent fins. In addition, although the outdoor heat exchanger 5-1 includes the two parallel heat exchangers 50-11 and 50-12 in Embodiment 1, the outdoor heat exchanger 5-1** may include a freely-selectable number of two or more parallel heat exchangers.

Referring back to FIG. 1, the parallel heat exchangers 50-11 and 50-12 are connected to the second extension pipe 12-1 through the first connection pipes 13-11 and 13-12, respectively. The first connection pipes 13-11 and 13-12 are provided with second expansion devices 7-11 and 7-12, respectively. A portion of the first connection pipe 13-11 between the second expansion device 7-11 and the parallel heat exchanger 50-11 is connected to a portion of the first connection pipe 13-12 between the second expansion device 7-12 and the parallel heat exchanger 50-12 through a bypass pipe. The bypass pipe is provided with a second expansion device 7-13. The second expansion devices 7-11, 7-12, and 7-13 are each formed of, for example, an electronic expansion valve. The second expansion devices 7-11, 7-12, and 7-13 are each capable of changing the opening degree in response to an instruction from the controller 30.

The parallel heat exchangers 50-11 and 50-12 are connected to the cooling/heating switching device 2-1 through the second connection pipes 14-11 and 14-12, respectively. The second connection pipes 14-11 and 14-12 are provided with first solenoid valves 8-11 and 8-12, respectively. The first solenoid valves 8-11 and 8-12 each open or close the flow passage in response to an instruction from the controller 30.

The discharge pipe **1*a*-1 is provided with a check valve 16-1 that allows refrigerant discharged from the compressor 1-1 to flow toward the cooling/heating switching device 2-1 and prevents backflow during the heating operation, for example. Various configurations are applicable as long as backflow can be prevented when the discharge pressure of the compressor 1-1 becomes lower than the pressures of the indoor units B and C, and thus a valve such as a solenoid valve may be used instead of the check valve 16-1. A portion of the discharge pipe 1*a*-1 on the upstream side of the check valve 16-1 (the compressor 1-1 side) is connected to portions of the second connection pipes 14-11 and 14-12 between the parallel heat exchangers 50-11 and 50-12 and the first solenoid valves 8-11 and 8-12 through a defrosting pipe 15-1. One end of the defrosting pipe 15-1 is connected to the discharge pipe 1*a*-1, and the other end branches off to be connected to the second connection pipes 14-11 and 14-12. The defrosting pipe 15-1 supplies a part (or whole) of high-temperature and high-pressure refrigerant discharged from the compressor 1-1 and for use in defrosting to the parallel heat exchangers 50-11 and 50-12 of the outdoor heat exchanger 5-1**.

The defrosting pipe 15-1 is provided with a first expansion device 10-1 serving as a decompressor. The first expansion device 10-1 reduces the pressure of the high-temperature and high-pressure refrigerant having flowed into the defrosting pipe 15-1 from the discharge pipe 1*a*-1 to a medium pressure. Here, a medium pressure is a pressure lower than a high-pressure side pressure (for example, a pressure in a condenser) and higher than a low-pressure side pressure (for example, a pressure in an evaporator) in the refrigerant circuit. The medium-pressure refrigerant obtained through decompression performed by the first expansion device 10-1 passes through the second connection pipes 14-11 and 14-12 and flows into the parallel heat exchangers 50-11 and 50-12. Accordingly, defrosting is performed in the parallel heat exchangers 50-11 and 50-12 by using the medium-pressure refrigerant.

The pipes branched at the other end of the defrosting pipe 15-1 are provided with second solenoid valves 9-11 and 9-12, respectively. The second solenoid valves 9-11 and 9-12 control a flow of the medium-pressure refrigerant that is to flow into any one of the second connection pipes 14-11 and 14-12. Here, the types of the first solenoid valves 8-11 and 8-12 and the second solenoid valves 9-11 and 9-12 are not limited as long as those valves are capable of controlling a flow of refrigerant, for example, a four-way valve, a three-way valve, or a two-way valve may be used.

In Embodiment 1, the defrosting pipe 15-1, the first solenoid valves 8-11 and 8-12, the second solenoid valves 9-11 and 9-12, and the second expansion devices 7-11, 7-12, and 7-13 form a defrosting circuit and a flow switching device. The defrosting circuit causes a part (or whole) of refrigerant discharged from the compressor 1-1 to branch off and to flow into a selected parallel heat exchanger subjected to defrosting among the plurality of parallel heat exchangers 50-11 and 50-12. Opening and closing of the first solenoid valves 8-11 and 8-12 and the second solenoid valves 9-11 and 9-12 are controlled by the controller 30.

When a required defrosting capacity (a flow rate of refrigerant required for defrosting) is determined in advance, a fixed expansion such as a capillary tube may be used as the first expansion device 10-1. Instead of providing the first expansion device 10-1, the second solenoid valves 9-11 and 9-12 may be downsized so that the pressure of refrigerant decreases to a medium pressure when a defrosting flow rate is a flow rate set in advance. Alternatively, instead of the second solenoid valves 9-11 and 9-12, a flow rate control device capable of controlling a flow rate of refrigerant in a continuous or multistage manner may be installed. In this case, installation of the first expansion device 10-1 can be omitted.

The heat source unit A-1 is provided with various sensors. The controller 30 controls, on the basis of detection signals from the various sensors, the frequency of the compressor 1-1 and devices serving as actuators, such as the outdoor fan 5*f*-1 and various flow rate control devices. Here, description is made of, as some of the various sensors, sensors that are necessary mainly to perform defrosting or determine the end of defrosting.

The defrosting pipe 15-1 is provided with a pressure sensor 21-11 that detects a refrigerant pressure in the pipe. The pressure sensor 21-11 detects a refrigerant pressure in the parallel heat exchanger 50-11 when the second solenoid valve 9-11 is open, and detects a refrigerant pressure in the parallel heat exchanger 50-12 when the second solenoid valve 9-12 is open. The first connection pipes 13-11 and 13-12 are provided with temperature sensors 22-11 and 22-12, respectively, which detect temperatures of refrigerant flowing out of the parallel heat exchangers 50-11 and 50-12 at the time of performing defrosting. In the case of controlling pressures in the parallel heat exchangers 50-11 and 50-12 subjected to defrosting, a detection value obtained from the pressure sensor 21-11 is used. To determine the end of defrosting, a degree of subcooling SC of refrigerant flowing out of the parallel heat exchangers 50-11 and 50-12 is used. The degree of subcooling SC is calculated by using a difference between a saturated liquid temperature based on the pressure detected by the pressure sensor 21-11 and the temperatures detected by the temperature sensors 22-11 and 22-12. To detect a refrigerant pressure in a parallel heat exchanger subjected to defrosting, pressure sensors may be provided in the first connection pipes 13-11 and 13-12, respectively, for example, instead of the pressure sensor 21-11.

Other sensors, including a temperature sensor 22-14 that detects a temperature of refrigerant to be sucked into the compressor 1-1, a pressure sensor 21-12 that detects a pressure of refrigerant discharged from the compressor 1-1, a temperature sensor 22-13 that detects a temperature of refrigerant in a gas-side pipe connecting the outdoor heat exchanger 5-1 and the cooling/heating switching device 2-1, and a temperature sensor 23 that detects an outdoor air temperature, are also provided. The controller 30 may obtain information about an outdoor air temperature from the outside.

The heat source unit A-2 has a configuration similar to that of the heat source unit A-1. That is, a compressor 1-2, a discharge pipe 1*a*-2, a suction pipe 1*b*-2, the cooling/heating switching device 2-2, the outdoor heat exchanger 5-2, an outdoor fan 5*f*-2, an accumulator 6-2, second expansion devices 7-21, 7-22, and 7-23, first solenoid valves 8-21 and 8-22, second solenoid valves 9-21 and 9-22, a first expansion device 10-2, first connection pipes 13-21 and 13-22, second connection pipes 14-21 and 14-22, a defrosting pipe 15-2, a check valve 16-2, pressure sensors 21-21 and 21-22, temperature sensors 22-21, 22-22, 22-23, and 22-24, and the parallel heat exchangers 50-21 and 50-22 of the heat source unit A-2 correspond to the compressor 1-1, the discharge pipe 1*a*-1, the suction pipe 1*b*-1, the cooling/heating switching device 2-1, the outdoor heat exchanger 5-1, the outdoor fan 5*f*-1, the accumulator 6-1, the second expansion devices 7-11, 7-12, and 7-13, the first solenoid valves 8-11 and 8-12, the second solenoid valves 9-11 and 9-12, the first expansion device 10-1, the first connection pipes 13-11 and 13-12, the second connection pipes 14-11 and 14-12, the defrosting pipe 15-1, the check valve 16-1, the pressure sensors 21-11 and 21-12, the temperature sensors 22-11, 22-12, 22-13, and 22-14, and the parallel heat exchangers 50-11 and 50-12 of the heat source unit A-1, respectively. In Embodiment 1, the temperature sensor 23 that detects an outdoor air temperature is provided only in the heat source unit A-1.

Figure 4:
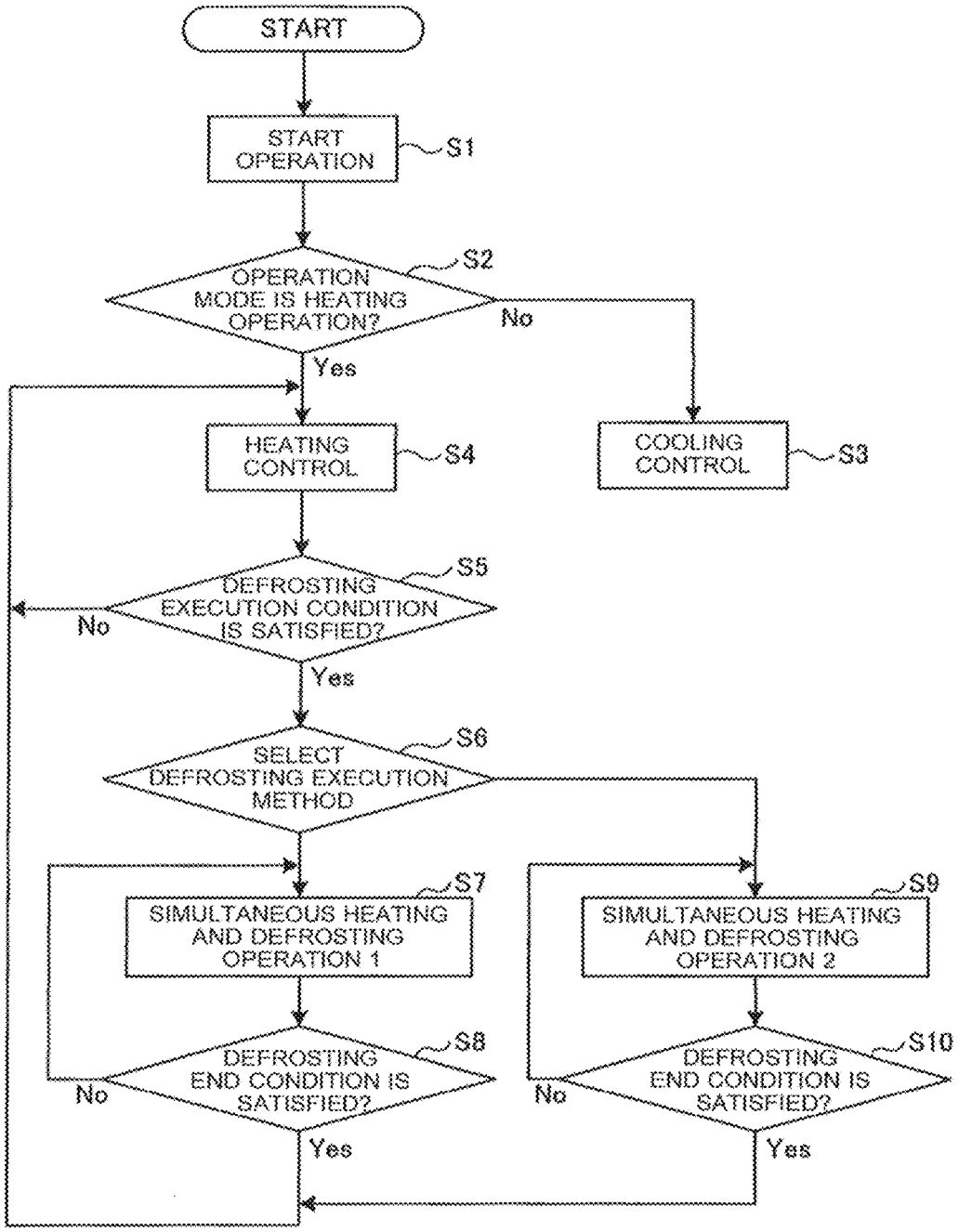
FIG. 4 is a flowchart for illustrating an example of a flow of control performed by a controller 30 of the air-conditioning apparatus 100 of Embodiment 1 of the present invention.

Next, operations in the various operation modes of the air-conditioning apparatus 100 are described. FIG. 4 is a flowchart for illustrating an example of a flow of control performed by the controller 30 of the air-conditioning apparatus 100 of Embodiment 1. When an operation of the air-conditioning apparatus 100 is started (Step S1), the controller 30 sets the operation mode of the indoor unit B and the indoor unit C to the cooling operation or the heating operation in response to an instruction given by a user through use of, for example, a remote control (Step S2). When the operation mode is set to the cooling operation, the controller 30 performs predetermined cooling control (Step S3). When the operation mode is set to the heating operation, the controller 30 controls, for example, the cooling/heating switching devices 2-1 and 2-2, the flow rate control devices 4-*b* and 4-*c*, the second expansion devices 7-11, 7-12, 7-21, and 7-22, the first solenoid valves 8-11, 8-12, 8-21, and 8-22, the second solenoid valves 9-11, 9-12, 9-21, and 9-22, and the first expansion devices 10-1 and 10-2, and performs any one of the normal heating operation, the simultaneous heating and defrosting operation 1 (also referred to as a continuous heating operation), and the simultaneous heating and defrosting operation 2. In this example, when the operation mode is set to the heating operation, the controller 30 first sets the sub operation mode to the normal heating operation and performs predetermined heating control (Step S4). The normal heating operation is a sub operation mode in which all the parallel heat exchangers 50-11, 50-12, 50-21, and 50-22 forming the outdoor heat exchangers 5-1 and 5-2 operate as normal evaporators.

In the normal heating operation, the controller 30 determines whether or not a defrosting execution condition is satisfied (Step S5). Determination of whether or not the defrosting execution condition is satisfied is performed by using, for example, an outdoor air temperature and a low-pressure side pressure of a refrigeration cycle. When it is determined that the defrosting execution condition is satisfied, the controller 30 selects and performs, as a defrosting execution method, any one of the simultaneous heating and defrosting operation 1 and the simultaneous heating and defrosting operation 2, for example (Step S6). After the simultaneous heating and defrosting operation 1 or the simultaneous heating and defrosting operation 2 starts, the operation is continued until the controller 30 determines that a defrosting end condition is satisfied (Steps S7 to S10). Meanwhile, when it is determined in Step S5 that the defrosting execution condition is not satisfied, the process returns to Step S4, where the controller 30 continues the predetermined heating control and repeats, at predetermined time intervals, determination of whether or not the defrosting execution condition is satisfied.

The simultaneous heating and defrosting operation 1 is a sub operation mode in which one or some parallel heat exchangers among the plurality of parallel heat exchangers 50-11, 50-12, 50-21, and 50-22 (for example, one parallel heat exchanger in each heat source unit) are sequentially selected as parallel heat exchangers to be subjected to defrosting. The above-described defrosting circuit causes part of refrigerant discharged from a compressor to flow into a selected parallel heat exchanger subjected to defrosting. Meanwhile, a parallel heat exchanger other than the parallel heat exchanger subjected to defrosting operates as a normal evaporator. For example, in the simultaneous heating and defrosting operation 1, a heating operation is performed with the one parallel heat exchanger 50-11 of the heat source unit A-1 (the outdoor heat exchanger 5-1) operating as an evaporator, while defrosting of the other parallel heat exchanger 50-12 is being performed. After defrosting of the parallel heat exchanger 50-12 ends, a heating operation is performed with the parallel heat exchanger 50-12 operating as an evaporator, while defrosting of the parallel heat exchanger 50-11 is being performed. In the simultaneous heating and defrosting operation 1, it is possible to alternately defrost the parallel heat exchangers 50-11 and 50-12 and alternately defrost the parallel heat exchangers 50-21 and 50-22 while continuing a heating operation.

The simultaneous heating and defrosting operation 2 is a sub operation mode in which defrosting of all the parallel heat exchangers of one of the plurality of heat source units A-1 and A-2 (for example, one heat source unit) is performed (hereinafter it may be referred to as "full defrosting") and also a heating operation is performed with the parallel heat exchangers of the other heat source unit operating as evaporators. That is, in the simultaneous heating and defrosting operation 2, full defrosting is alternately performed on the heat source units A-1 and A-2 while a heating operation is being continued. For example, a heating operation is performed with all the parallel heat exchangers 50-11 and 50-12 of the one heat source unit A-1 operating as evaporators, while defrosting of all the parallel heat exchangers 50-21 and 50-22 of the other heat source unit A-2 is being simultaneously performed. After defrosting of the parallel heat exchangers 50-21 and 50-22 ends, a heating operation is performed with all the parallel heat exchangers 50-21 and 50-22 of the heat source unit A-2 operating as evaporators, while defrosting of all the parallel heat exchangers 50-11 and 50-12 of the heat source unit A-1 is being simultaneously performed.

The simultaneous heating and defrosting operation 1 and the simultaneous heating and defrosting operation 2 are performed when a low-pressure side pressure of a refrigeration cycle and temperatures detected in the outdoor heat exchangers 5-1 and 5-2 decrease and when it is determined that the outdoor heat exchangers 5-1 and 5-2 are frosted during the normal heating operation. A method of selecting any one of the simultaneous heating and defrosting operation 1 and the simultaneous heating and defrosting operation 2 is described below with reference to FIG. 15.

FIG. 5 is a diagram for illustrating an example of states of individual valves in individual operation modes of the air-conditioning apparatus 100 of Embodiment 1. In FIG. 5, the reference signs of the cooling/heating switching devices 2-1 and 2-2, the second expansion devices 7-11, 7-12, 7-13, 7-21, 7-22, and 7-23, the first solenoid valves 8-11, 8-12, 8-21, and 8-22, the second solenoid valves 9-11, 9-12, 9-21, and 9-22, the first expansion devices 10-1 and 10-2, and the flow rate control devices 4-b and 4-*c* are illustrated as "valve numbers". For example, "ON" for the cooling/heating switching devices 2-1 and 2-2 indicates a state in which the flow passage is switched as indicated by a solid line in FIG. 1, and "OFF" indicates a state in which the flow passage is switched as indicated by a dotted line in FIG. 1. For example, "ON" for the first solenoid valves 8-11, 8-12, 8-21, and 8-22 and the second solenoid valves 9-11, 9-12, 9-21, and 9-22 indicates a state in which the valves are open so that refrigerant is allowed to flow, and "OFF" indicates a state in which the valves are closed so that refrigerant is not allowed to flow. For example, "defrosting heat exchange pressure" for the second expansion devices 7-13 and 7-23 indicates that the opening degrees of the second expansion devices 7-13 and 7-23 are controlled so that a refrigerant pressure in the parallel heat exchanger subjected to defrosting is within a predetermined pressure range.

In the individual operation modes described below, the states of the individual valves are set as illustrated in FIG. 5 through the control of the controller 30.

[Cooling Operation]

Figure 6:
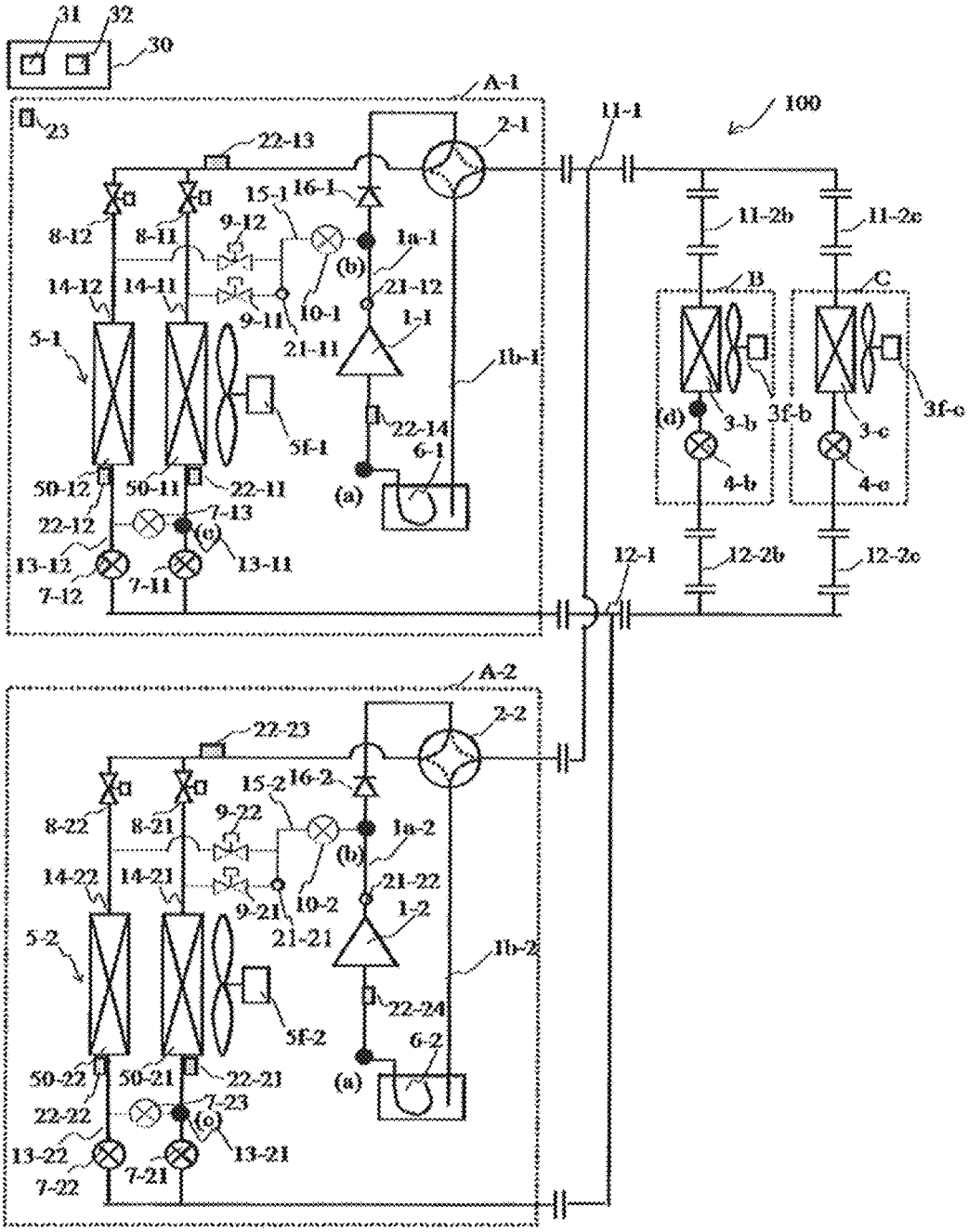
FIG. 6 is a diagram for illustrating a flow of refrigerant during a cooling operation of the air-conditioning apparatus 100 of Embodiment 1 of the present invention.
Figure 7:
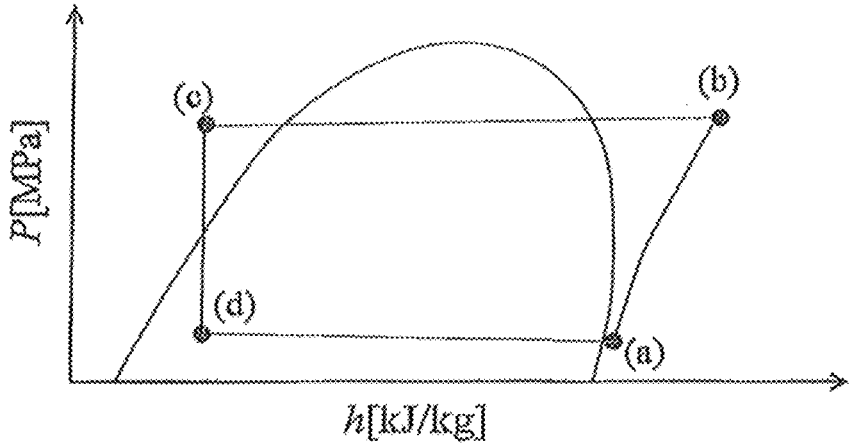
FIG. 7 is a P-h chart during the cooling operation of the air-conditioning apparatus 100 of Embodiment 1 of the present invention.

FIG. 6 is a diagram for illustrating a flow of refrigerant during the cooling operation of the air-conditioning apparatus 100 of Embodiment 1. In FIG. 6, a portion in which refrigerant flows is indicated by a bold line, and a portion in which no refrigerant flows is indicated by a thin line. FIG. 7 is a P-h chart during the cooling operation of the air-conditioning apparatus 100 of Embodiment 1. The points (a) to (d) in FIG. 7 indicate states of refrigerant in portions (a) to (d) in FIG. 6, respectively.

As illustrated in FIG. 6 and FIG. 7, the compressor 1-1 of the heat source unit A-1 suctions and compresses low-temperature and low-pressure gas refrigerant and discharges high-temperature and high-pressure gas refrigerant (point (a) to point (b) in FIG. 7). Part of the high-temperature and high-pressure gas refrigerant discharged from the compressor 1-1 passes through the cooling/heating switching device 2-1, the first solenoid valve 8-11, and the second connection pipe 14-11 and flows into the parallel heat exchanger 50-11. Another part of the high-temperature and high-pressure gas refrigerant passes through the cooling/heating switching device 2-1, the first solenoid valve 8-12, and the second connection pipe 14-12 and flows into the parallel heat exchanger 50-12. The gas refrigerant having flowed into the parallel heat exchangers 50-11 and 50-12 transfers condensation heat to outdoor air sent by the outdoor fan 5*f*-1 to be condensed and become medium-temperature and high-pressure liquid refrigerant (point (b) to point (c) in FIG. 7).

The medium-temperature and high-pressure liquid refrigerant having flowed out of the parallel heat exchangers 50-11 and 50-12 passes through the first connection pipes 13-11 and 13-12, the second expansion devices 7-11 and 7-12 that are fully opened, and the second extension pipe 12-1, and join medium-temperature and high-pressure liquid refrigerant having flowed out of the heat source unit A-2. The flow of refrigerant in the heat source unit A-2 is similar to that in the heat source unit A-1, and thus the description thereof is omitted. The medium-temperature and high-pressure liquid refrigerant branches into refrigerant flowing through the second extension pipes 12-2*b* and 12-2*c*, and the refrigerant passes through the flow rate control devices 4-*b* and 4-*c*. The refrigerant having passed through the flow rate control devices 4-*b* and 4-*c* is expanded and decompressed, and becomes low-temperature and low-pressure two-phase gas-liquid refrigerant (point (c) to point (d) in FIG. 7).

The low-temperature and low-pressure two-phase gas-liquid refrigerant having flowed out of the flow rate control devices 4-*b* and 4-*c* flows into the indoor heat exchangers 3-*b* and 3-*c*, receives evaporation heat from indoor air to evaporate, and becomes low-temperature and low-pressure gas refrigerant (point (d) to point (a) in FIG. 7). Here, the controller 30 controls the flow rate control devices 4-*b* and 4-*c* so that the superheat (a degree of superheat) of the low-temperature and low-pressure gas refrigerant indicated by the point (a) in FIG. 7 becomes from about 2 K to about 5 K.

The low-temperature and low-pressure gas refrigerant having flowed out of the indoor heat exchangers 3-*b* and 3-*c* passes through the first extension pipes 11-2*b* and 11-2*c*, joins together, and is then branched at the first extension pipe 11-1 into gas refrigerant flowing into the heat source units A-1 and A-2. The gas refrigerant having flowed into the heat source unit A-1 passes through the cooling/heating switching device 2-1 and the accumulator 6-1 and is then sucked into the compressor 1-1.

[Normal Heating Operation]

Figure 8:
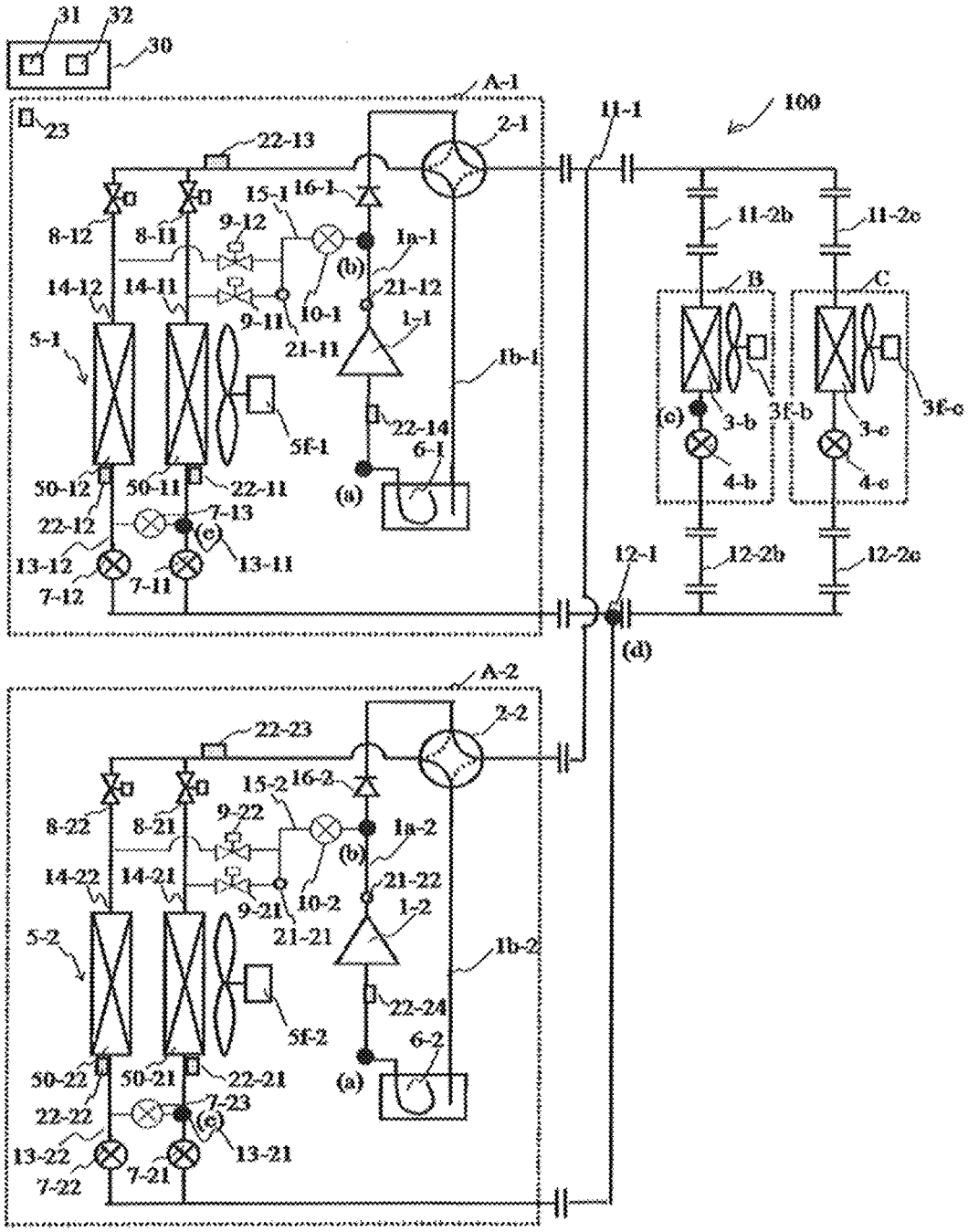
FIG. 8 is a diagram for illustrating a flow of refrigerant during a normal heating operation of the air-conditioning apparatus 100 of Embodiment 1 of the present invention.
Figure 9:
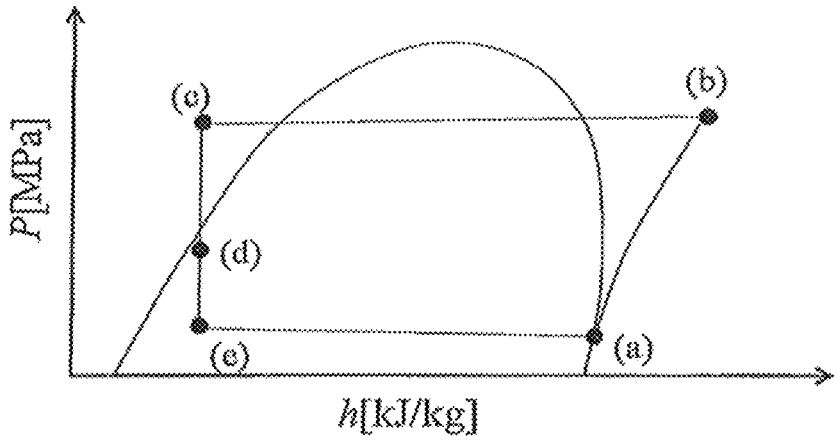
FIG. 9 is a P-h chart during the normal heating operation of the air-conditioning apparatus 100 of Embodiment 1 of the present invention.

FIG. 8 is a diagram for illustrating a flow of refrigerant during the normal heating operation of the air-conditioning apparatus 100 of Embodiment 1. In FIG. 8, a portion in which refrigerant flows is indicated by a bold line, and a portion in which no refrigerant flows is indicated by a thin line. FIG. 9 is a P-h chart during the normal heating operation of the air-conditioning apparatus 100 of Embodiment 1. The points (a) to (e) in FIG. 9 indicate states of refrigerant in portions (a) to (e) in FIG. 8, respectively.

As illustrated in FIG. 8 and FIG. 9, the compressor 1-1 of the heat source unit A-1 suctions and compresses low-temperature and low-pressure gas refrigerant and discharges high-temperature and high-pressure gas refrigerant (point (a) to point (b) in FIG. 9). The high-temperature and high-pressure gas refrigerant discharged from the compressor 1-1 passes through the cooling/heating switching device 2-1 and the first extension pipe 11-1 and join gas refrigerant having flowed out of the heat source unit A-2. The high-temperature and high-pressure gas refrigerant branches into gas refrigerant flowing through the first extension pipes 11-2*b* and 11-2*c*, and the gas refrigerant flows into the indoor heat exchangers 3-*b* and 3-*c* of the indoor units B and C. The gas refrigerant having flowed into the indoor heat exchangers 3-*b* and 3-*c* transfers condensation heat to indoor air sent by the indoor fans 3*f*-*b* and 3*f*-*c* and becomes medium-temperature and high-pressure liquid refrigerant (point (b) to point (c) in FIG. 9).

The medium-temperature and high-pressure liquid refrigerant having flowed out of the indoor heat exchangers 3-*b* and 3-*c* passes through the flow rate control devices 4-*b* and 4-*c*. The liquid refrigerant having passed through the flow rate control devices 4-*b* and 4-*c* is expanded, decompressed, and brought into a medium-pressure two-phase gas-liquid state (point (c) to point (d) in FIG. 9). Here, the controller 30 controls the flow rate control devices 4-*b* and 4-*c* so that the subcooling (a degree of subcooling) of the medium-temperature and high-pressure liquid refrigerant indicated by the point (c) in FIG. 9 becomes from about 5 K to about 20 K.

The medium-pressure two-phase gas-liquid refrigerant having flowed out of the flow rate control devices 4-*b* and 4-*c* passes through the second extension pipes 12-2*b* and 12-2*c*, joins together, and is then branched at the second extension pipe 12-1 into two-phase gas-liquid refrigerant flowing into the heat source units A-1 and A-2. Part of the two-phase gas-liquid refrigerant having flowed into the heat source unit A-1 passes through the first connection pipe 13-11 and the second expansion device 7-11. Another part of the two-phase gas-liquid refrigerant having flowed into the heat source unit A-1 passes through the first connection pipe 13-12 and the second expansion device 7-12. The refrigerant having passed through the second expansion devices 7-11 and 7-12 is expanded and decompressed, and becomes low-pressure two-phase gas-liquid refrigerant (point (d) to point (e) in FIG. 9). Here, the controller 30 performs control so that the second expansion devices 7-11 and 7-12 are fixed at a predetermined opening degree (for example, fully opened) or so that the saturation temperature of a medium pressure in the second extension pipe 12-1 and other components becomes from about 0 degrees Celsius to about 20 degrees Celsius.

The low-pressure two-phase gas-liquid refrigerant having flowed out of the second expansion devices 7-11 and 7-12 flows into the parallel heat exchangers 50-11 and 50-12. The two-phase gas-liquid refrigerant having flowed into the parallel heat exchangers 50-11 and 50-12 receives evaporation heat from outdoor air sent by the outdoor fan 5*f*-1 to evaporate, and becomes low-temperature and low-pressure gas refrigerant (point (e) to point (a) in FIG. 9).

The low-temperature and low-pressure gas refrigerant having flowed out of the parallel heat exchangers 50-11 and 50-12 passes through the second connection pipes 14-11 and 14-12 and the first solenoid valves 8-11 and 8-12 and joins together, and the joined gas refrigerant passes through the cooling/heating switching device 2-1 and the accumulator 6-1 and is then sucked into the compressor 1-1.

[Reverse Defrosting Operation]

In Embodiment 1, the reverse defrosting operation is not performed in normal cases. However, the reverse defrosting operation may be performed to bring the outdoor heat exchangers 5-1 and 5-2 into a non-frosted state when an outdoor air temperature significantly decreases or suction pressures of the compressors 1-1 and 1-2 significantly decrease while a cycle of the normal heating operation, the simultaneous heating and defrosting operation 1, and the simultaneous heating and defrosting operation 2 is being repeated.

In the case of performing the reverse defrosting operation, the controller 30 switches the flow passage of the cooling/heating switching device 2-1 similarly to the cooling operation. Accordingly, high-temperature gas refrigerant discharged from the compressor 1-1 flows into the parallel heat exchangers 50-11 and 50-12. In the parallel heat exchangers 50-11 and 50-12, the refrigerant is cooled down while melting the frost stacked on the fins 5*b*. After that, the refrigerant having flowed out of the parallel heat exchangers 50-11 and 50-12 passes through the second expansion devices 7-11 and 7-12 and the second extension pipe 12-1 and joins refrigerant having flowed out of the heat source unit A-2. The joined refrigerant passes through the second extension pipes 12-2*b* and 12-2*c*, the flow rate control devices 4-*b* and 4-*c*, the indoor heat exchangers 3-*b* and 3-*c*, and the first extension pipes 11-2*b*, 11-2*c*, and 11-1, and branches into refrigerant flowing into the heat source units A-1 and A-2. The refrigerant having flowed into the heat source unit A-1 passes through the cooling/heating switching device 2-1 and the accumulator 6-1 and is sucked into the compressor 1-1.

During the reverse defrosting operation, the controller 30 stops the indoor fans 3*f*-*b* and 3*f*-*c* to prevent cold wind from blowing from the indoor units B and C to the inside of a room. In addition, the controller 30 performs control to fully open the second expansion devices 7-11, 7-12, 7-21, and 7-22 and the flow rate control devices 4-*b* and 4-*c* so that a decrease in suction pressures of the compressors 1-1 and 1-2 can be prevented as much as possible.

[Simultaneous Heating and Defrosting Operation 1 (Continuous Heating Operation)]

The simultaneous heating and defrosting operation 1 is performed when it is determined in Step S5 in FIG. 4 that the defrosting execution condition is satisfied (for example, when it is detected that the outdoor heat exchangers 5-1 and 5-2 are frosted) and when the simultaneous heating and defrosting operation 1 is selected in Step S6 during the normal heating operation.

In the configuration of Embodiment 1, two operation methods are available in the simultaneous heating and defrosting operation 1. In a first operation method, one of the parallel heat exchangers is regarded as a parallel heat exchanger subjected to defrosting, and the remaining parallel heat exchanger is operated as an evaporator in each of the plurality of heat source units A-1 and A-2. In a second operation method, only one of the parallel heat exchangers of one of the plurality of heat source units A-1 and A-2 is regarded as a parallel heat exchanger subjected to defrosting, and the remaining parallel heat exchangers operate as evaporators. That is, in the second operation method, there are both a parallel heat exchanger operating as an evaporator and a parallel heat exchanger to be defrosted in one of the plurality of heat source units A-1 and A-2. Meanwhile, in the other heat source unit, all the parallel heat exchangers operate as evaporators as in the normal heating operation.

In Embodiment 1, description is made of a flow of refrigerant in the simultaneous heating and defrosting operation 1 using the first operation method. A flow of refrigerant in the simultaneous heating and defrosting operation 1 using the second operation method is a combination of a flow of refrigerant in the first operation method and a flow of refrigerant in the above-described normal heating operation. That is, the operations are the same except that the opened/closed states of the first solenoid valves 8-11 and 8-12 and the opened/closed states of the second solenoid valves 9-11 and 9-12 are reversed and the flows of refrigerant in the parallel heat exchanger 50-11 and the parallel heat exchanger 50-12 are changed in accordance with which parallel heat exchanger is to be defrosted. Thus, description is made below of an operation in a case where the parallel heat exchanger 50-12 of the heat source unit A-1 and the parallel heat exchanger 50-22 of the heat source unit A-2 are parallel heat exchangers subjected to defrosting, and the parallel heat exchanger 50-11 of the heat source unit A-1 and the parallel heat exchanger 50-21 of the heat source unit A-2 operate as evaporators. The same applies to the description of the following embodiments.

Figure 10:
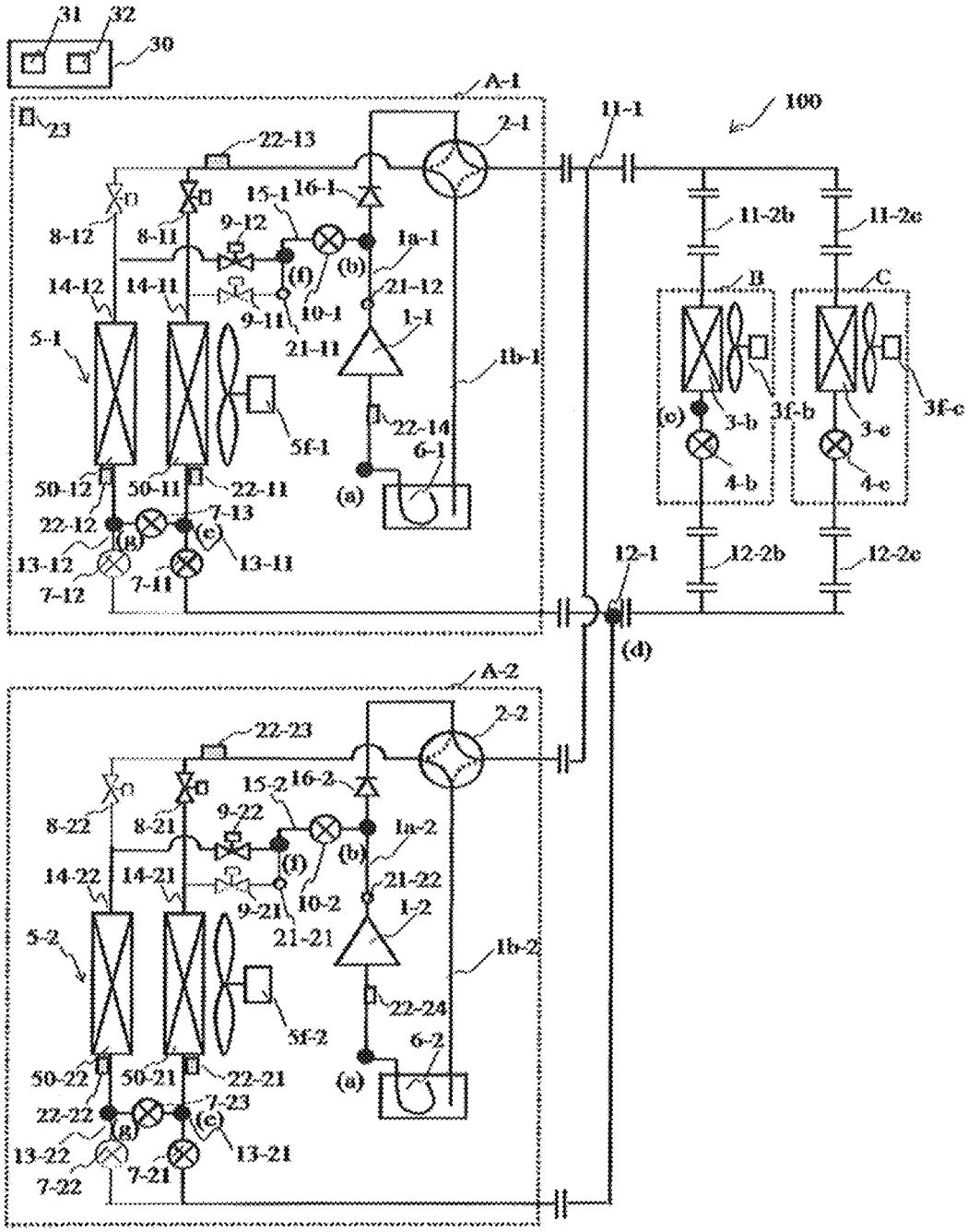
FIG. 10 is a diagram for illustrating a flow of refrigerant during a simultaneous heating and defrosting operation 1 of the air-conditioning apparatus 100 of Embodiment 1 of the present invention.
Figure 11:
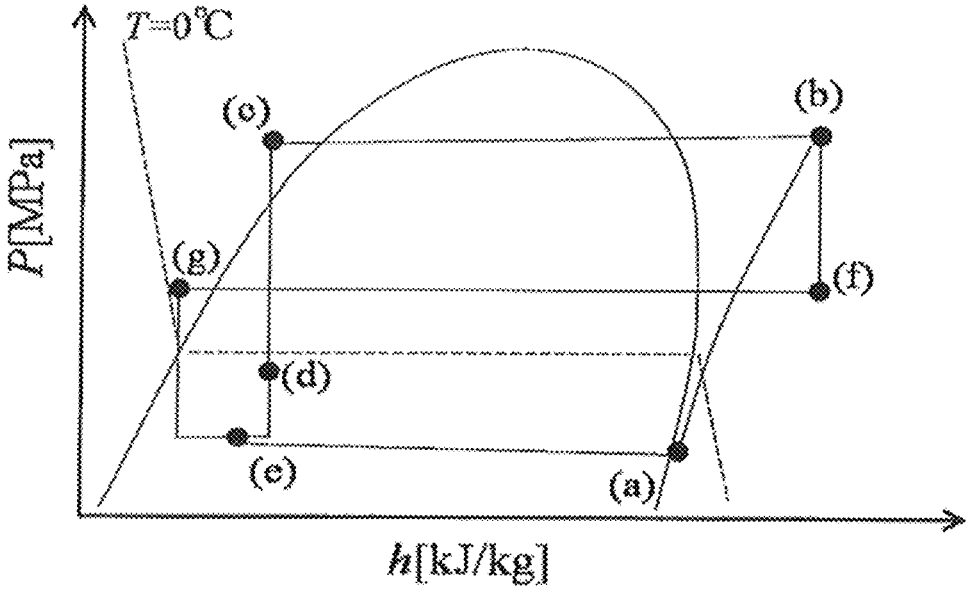
FIG. 11 is a P-h chart during the simultaneous heating and defrosting operation 1 of the air-conditioning apparatus 100 of Embodiment 1 of the present invention.

FIG. 10 is a diagram for illustrating a flow of refrigerant during the simultaneous heating and defrosting operation 1 of the air-conditioning apparatus 100 of Embodiment 1. In FIG. 10, a portion in which refrigerant flows is indicated by a bold line, and a portion in which no refrigerant flows is indicated by a thin line. FIG. 11 is a P-h chart during the simultaneous heating and defrosting operation 1 of the air-conditioning apparatus 100 of Embodiment 1. The points (a) to (g) in FIG. 11 indicate states of refrigerant in portions (a) to (g) in FIG. 10, respectively. In FIG. 11, the isotherm of 0 degrees Celsius, which is the melting point of frost, is indicated by a broken line.

When the controller 30 determines that defrosting for resolving a frosted state of a parallel heat exchanger (for example, the parallel heat exchanger 50-12) needs to be performed and selects the simultaneous heating and defrosting operation 1 while the normal heating operation is being performed, the controller 30 performs control to fully open the first solenoid valve 8-12 and the second expansion device 7-12 corresponding to the parallel heat exchanger subjected to defrosting. In addition, the controller 30 performs control to open the second solenoid valve 9-12 corresponding to the parallel heat exchanger 50-12 subjected to defrosting and to set the opening degree of the first expansion device 10-1 to an opening degree set in advance. Accordingly, a defrosting circuit in which the compressor 1-1, the first expansion device 10-1, the second solenoid valve 9-12, the parallel heat exchanger 50-12, and the second expansion device 7-13 are sequentially connected is formed in addition to a main circuit. Meanwhile, the parallel heat exchanger 50-11 operates as an evaporator of the main circuit as in the normal heating operation. Accordingly, the simultaneous heating and defrosting operation 1 is performed.

In the simultaneous heating and defrosting operation 1 of Embodiment 1, the heat source unit A-2 is controlled to be operated symmetrically to the heat source unit A-1. That is, in the heat source unit A-2, a defrosting circuit including one of the parallel heat exchangers 50-21 and 50-22 is formed, and the other of the parallel heat exchangers 50-21 and 50-22 operates as an evaporator of a main circuit.

When the simultaneous heating and defrosting operation 1 is started, part of high-temperature and high-pressure gas refrigerant discharged from the compressor 1-1 flows into the defrosting pipe 15-1 and is decompressed to a medium pressure by the first expansion device 10-1. The change in the state of the refrigerant at this time is indicated by the point (b) to the point (f) in FIG. 11. The gas refrigerant decompressed to the medium pressure passes through the second solenoid valve 9-12 and flows into the parallel heat exchanger 50-12. The gas refrigerant having flowed into the parallel heat exchanger 50-12 is cooled down and condensed through heat exchange with frost on the parallel heat exchanger 50-12. In this way, as a result of allowing the medium-pressure gas refrigerant to flow into the parallel heat exchanger 50-12, the frost on the parallel heat exchanger 50-12 can be melted by using condensation latent heat of the medium-pressure refrigerant. The change in the state of the refrigerant at this time is indicated by the point (f) to the point (g) in FIG. 11.

Here, the second expansion device 7-13 is controlled so that a saturation temperature equivalent to the pressure of the medium-pressure refrigerant in the parallel heat exchanger 50-12 subjected to defrosting becomes from about 0 degrees Celsius to about 10 degrees Celsius, which is equal to or higher than the temperature of frost (0 degrees Celsius). That is, when R410 is used as refrigerant, the second expansion device 7-13 is controlled so that the pressure of the medium-pressure refrigerant becomes 0.80 MPa to 1.09 MPa. When R32 is used as refrigerant, the second expansion device 7-13 is controlled so that the pressure of the medium-pressure refrigerant becomes 0.81 MPa to 1.11 MPa. When HFO-1234yf is used as refrigerant, the second expansion device 7-13 is controlled so that the pressure of the medium-pressure refrigerant becomes 0.32 MPa to 0.44 MPa.

Meanwhile, the pressure of the refrigerant (point (d)) in portion (d) of the main circuit is determined by controlling the opening degree of the second expansion device 7-11.

The refrigerant having flowed out of the parallel heat exchanger 50-12 is decompressed by the second expansion device 7-13 and enters the main circuit at the first connection pipe 13-11 (point (e)). The entered refrigerant flows into the parallel heat exchanger 50-11 operating as an evaporator and evaporates through heat exchange with outdoor air.

The flow of refrigerant in the heat source unit A-2 is similar to that in the heat source unit A-1. Regarding the flow of refrigerant in the heat source unit A-2, for example, the above-described "compressor 1-1", "defrosting pipe 15-1", "first expansion device 10-1", "parallel heat exchanger 50-12", "second expansion device 7-11", and "second expansion device 7-13" may be replaced with "compressor 1-2", "defrosting pipe 15-2", "first expansion device 10-2", "parallel heat exchanger 50-22", "second expansion device 7-21", and "second expansion device 7-23", respectively.

As described above, in Embodiment 1, the pressure of the medium-pressure refrigerant flowing into the parallel heat exchanger subjected to defrosting is controlled so that the saturation temperature equivalent thereto becomes higher than 0 degrees Celsius and equal to or lower than 10 degrees Celsius. To suppress movement of refrigerant during defrosting and avoid uneven melting of frost while making the most of defrosting using the latent heat of the medium-pressure refrigerant, it is the most appropriate to set the target value of subcooling SC in the parallel heat exchanger subjected to defrosting to 0 K (quality of refrigerant is 0). However, considering the accuracy of a temperature sensor, a pressure sensor, and other sensors required to calculate the subcooling SC, it is desired to control the pressure of the medium-pressure refrigerant flowing into the parallel heat exchanger subjected to defrosting so that the saturation temperature equivalent to the pressure becomes higher than 0 degrees Celsius and equal to or lower than 6 degrees Celsius, for the purpose of obtaining a subcooling SC of from about 0 K to about 5 K.

[Simultaneous Heating and Defrosting Operation 2]

The simultaneous heating and defrosting operation 2 is performed when it is determined in Step S5 in FIG. 4 that the defrosting execution condition is satisfied (for example, when it is detected that the outdoor heat exchangers 5-1 and 5-2 are frosted) and when the simultaneous heating and defrosting operation 2 is selected in Step S6 during the normal heating operation.

In the simultaneous heating and defrosting operation 2, one heat source unit to be fully defrosted is selected (or a plurality of heat source units, not all heat source units, may be selected) from among the plurality of heat source units A-1 and A-2, and the normal heating operation is performed in the other heat source unit. The operations are the same except that the opened/closed states of the first solenoid valves 8-11 and 8-12 and the opened/closed states of the second solenoid valves 9-11 and 9-12 are reversed and the flows of refrigerant in the parallel heat exchanger 50-11 and the parallel heat exchanger 50-12 are changed in accordance with which heat source unit is to be selected for defrosting. Thus, description is made below of the case of performing a heating operation in the heat source unit A-1 while performing full defrosting in the heat source unit A-2. In the case of performing full defrosting in a heat source unit, the controller 30 stops the outdoor fan of the heat source unit to reduce heat transfer to outdoor air as much as possible.

Figure 12:
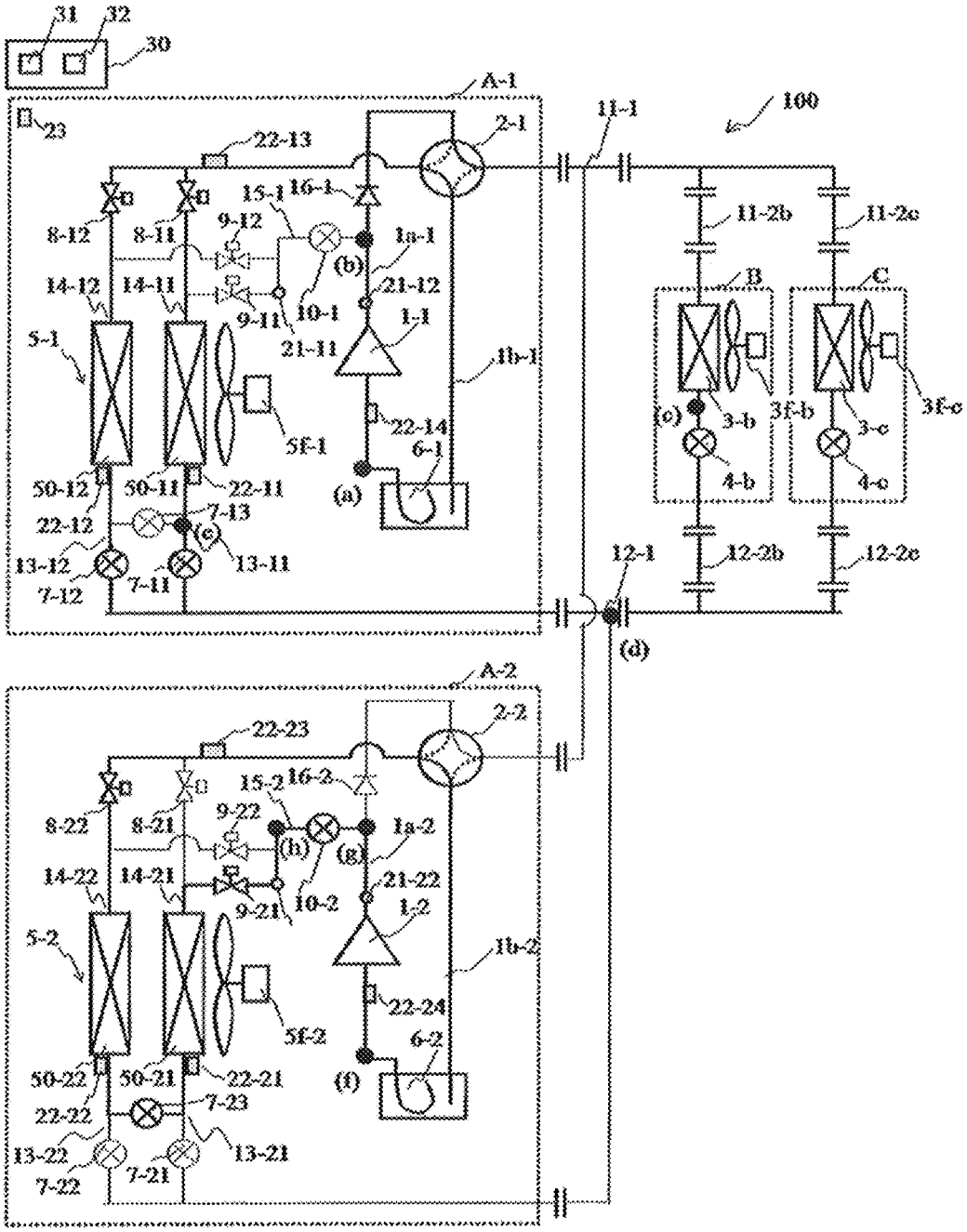
FIG. 12 is a diagram for illustrating a flow of refrigerant during a simultaneous heating and defrosting operation 2 of the air-conditioning apparatus 100 of Embodiment 1 of the present invention.
Figure 13:
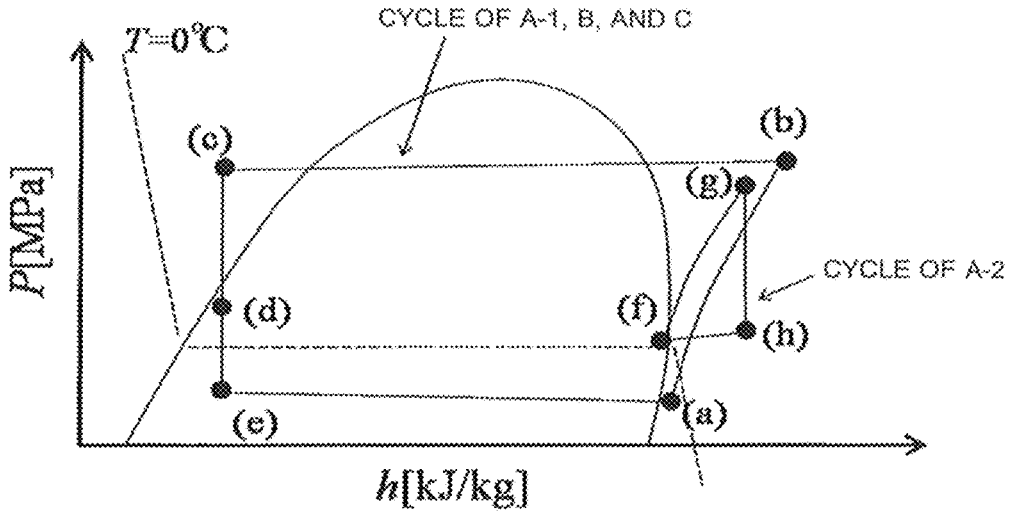
FIG. 13 is a P-h chart during the simultaneous heating and defrosting operation 2 of the air-conditioning apparatus 100 of Embodiment 1 of the present invention.

FIG. 12 is a diagram for illustrating a flow of refrigerant during the simultaneous heating and defrosting operation 2 of the air-conditioning apparatus 100 of Embodiment 1. In FIG. 12, a portion in which refrigerant flows is indicated by a bold line, and a portion in which no refrigerant flows is indicated by a thin line. FIG. 13 is a P-h chart during the simultaneous heating and defrosting operation 2 of the air-conditioning apparatus 100 of Embodiment 1. The points (a) to (h) in FIG. 13 indicate states of refrigerant in portions (a) to (h) in FIG. 12, respectively. The points (a) to (e) in FIG. 13 indicate a cycle of a main circuit formed of the heat source unit A-1 and the indoor units B and C, and the points (f) to (h) indicate a cycle of a defrosting circuit formed of the heat source unit A-2. In FIG. 13, the isotherm of 0 degrees Celsius, which is the melting point of frost, is indicated by a broken line.

When the controller 30 determines that defrosting for resolving a frosted state of a parallel heat exchanger needs to be performed and selects the simultaneous heating and defrosting operation 2 while the normal heating operation is being performed, the controller 30 performs control to fully open the first solenoid valve 8-21 corresponding to one of the parallel heat exchangers 50-21 and 50-22 (in this example the parallel heat exchanger 50-21) of the heat source unit to be subjected to defrosting (in this example the heat source unit A-2) and the second expansion devices 7-21 and 7-22 corresponding to both the parallel heat exchangers 50-21 and 50-22. In addition, the controller 30 performs control to open the second solenoid valve 9-21 corresponding to the one parallel heat exchanger 50-21 and to fully open the second expansion device 7-23. Furthermore, the controller 30 controls the opening degree of the first expansion device 10-2 so that the discharge pressure of the compressor 1-2 (for example, the pressure detected by the pressure sensor 21-22) does not exceed the pressure of the first extension pipe 11-1 (for example, the discharge pressure of the compressor 1-1 and the pressure detected by the pressure sensor 21-12). This is because, when the discharge pressure of the compressor 1-2 exceeds the pressure of the first extension pipe 11-1, the cycle of the defrosting circuit is not closed within the heat source unit A-2 and refrigerant flows into the main circuit from the defrosting circuit. For example, the discharge pressure of the compressor 1-2 increases as the opening degree of the first expansion device 10-2 decreases, and decreases as the opening degree of the first expansion device 10-2 increases.

Accordingly, a defrosting circuit in which the compressor 1-2, the first expansion device 10-2, the second solenoid valve 9-21, the parallel heat exchanger 50-21, the second expansion device 7-23, the parallel heat exchanger 50-22, the first solenoid valve 8-22, the cooling/heating switching device 2-2, and the accumulator 6-2 are sequentially and circularly connected is formed while being disconnected from the main circuit performing a heating operation. Accordingly, the simultaneous heating and defrosting operation 2 is performed.

When the simultaneous heating and defrosting operation 2 is started, a normal heating operation is performed in the main circuit formed of the heat source unit A-1 and the indoor units B and C.

Meanwhile, in the defrosting circuit formed of the heat source unit A-2, refrigerant flows in the following manner. Gas refrigerant discharged from the compressor 1-2 (point (g) in FIG. 13) flows into the defrosting pipe 15-2 and is decompressed by the first expansion device 10-2 (point (h) in FIG. 13). Here, the discharge pressure of the compressor 1-2 is lower than the pressure of the first extension pipe 11-1, and thus the gas refrigerant discharged from the compressor 1-2 does not flow into the first extension pipe 11-1. In addition, the discharge pipe 1*a*-2 is provided with the check valve 16-2, and hence backflow of high-pressure refrigerant from the first extension pipe 11-1 to the discharge pipe 1*a*-2 of the heat source unit A-2 does not occur.

The gas refrigerant decompressed by the first expansion device 10-2 passes through the parallel heat exchanger 50-21, the second expansion device 7-23, and the parallel heat exchanger 50-22 in the stated order and transfers heat to the frost on the parallel heat exchangers 50-21 and 50-22. Accordingly, the frost on the parallel heat exchangers 50-21 and 50-22 can be melted. The refrigerant having passed through the parallel heat exchangers 50-21 and 50-22 is cooled down to a temperature higher than the temperature of the frost (0 degrees Celsius or less) and flows out of the parallel heat exchanger 50-22 in the state of gas refrigerant or two-phase refrigerant (point (f) in FIG. 13). The refrigerant having flowed out of the parallel heat exchanger 50-22 passes through the second connection pipe 14-22, the first solenoid valve 8-22, and the suction pipe 1*b*-2 and flows into the accumulator 6-2. Gas refrigerant having a temperature slightly higher than 0 degrees Celsius and having a quality of almost 1 is sucked into the compressor 1-2 from the accumulator 6-2.

The defrosting circuit is completely disconnected, in the flow of refrigerant, from the main circuit by the second expansion devices 7-21 and 7-22 and the check valve 16-2. That is, there is no flowing in or flowing out of refrigerant between the defrosting circuit and the main circuit, and thus operation can be continued while preventing refrigerant shortages in the defrosting circuit. The saturation temperature equivalent to the suction pressure of the compressor 1-2 (point (f) in FIG. 13) is about 0 degrees Celsius, which is the melting point of frost. Accordingly, the suction pressure of the compressor 1-2 becomes higher than the suction pressure in the normal heating operation (for example, the suction pressure of the compressor 1-1 (point (a) in FIG. 13)) and the density of refrigerant increases. Thus, the defrosting flow rate can be increased and the defrosting capacity can be increased. Accordingly, defrosting can be completed in a short time although latent heat is not necessarily used in the defrosting. In addition, there is no parallel heat exchanger operating as an evaporator in the heat source unit A-2, and hence the outdoor fan 5*f*-2 can be stopped. Thus, an amount of heat transferred to outdoor air from the parallel heat exchangers 50-21 and 50-22 can be reduced even when an outdoor air temperature is low.

The controller 30 ends the simultaneous heating and defrosting operation 2 when the temperature detected by the temperature sensor 22-23 provided in a gas-side pipe between the outdoor heat exchanger 5-2 and the cooling/heating switching device 2-2 increases to about 10 degrees Celsius while the simultaneous heating and defrosting operation 2 is being performed.

As illustrated in FIG. 13, the points (f) to (h) are all in a gas region. Thus, in the defrosting circuit in the simultaneous heating and defrosting operation 2, a required amount of refrigerant is smaller than in the normal heating operation, and thus surplus refrigerant remains in the accumulator 6-2. However, when an outdoor air temperature is low, refrigerant condensed in the parallel heat exchangers 50-21 and 50-22 may remain in the parallel heat exchangers 50-21 and 50-22, and thus refrigerant shortages may occur at the beginning of a defrosting operation. Thus, a suction superheat may be calculated on the basis of the suction pressure of the compressor 1-2 and the suction temperature of the compressor 1-2 (for example, the temperature detected by the temperature sensor 22-24), and when the suction superheat is larger than a threshold set in advance, the second expansion devices 7-21 and 7-22 may be opened at a low opening degree so that liquid refrigerant is supplied from the main circuit to the defrosting circuit.

Figure 14:
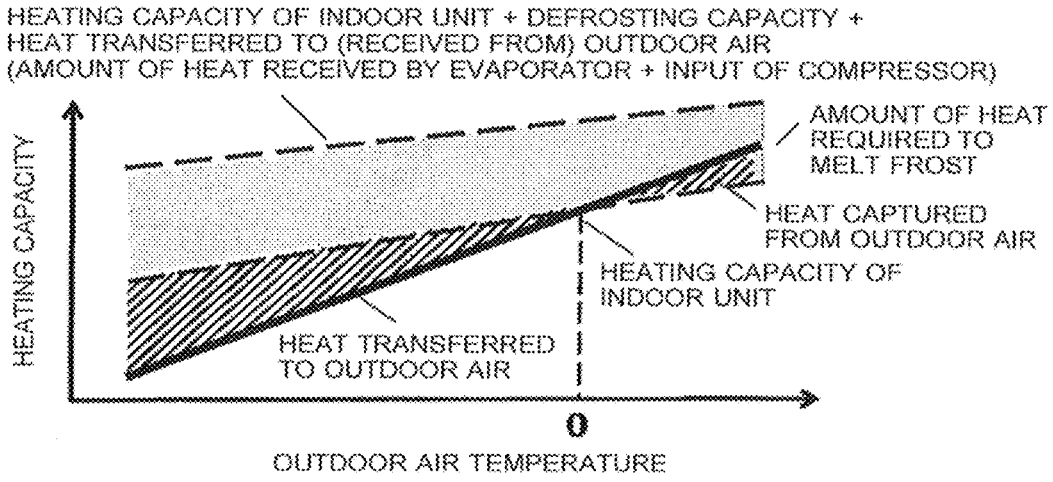
FIG. 14 is a graph for showing a heating capacity of the simultaneous heating and defrosting operation 1 to an outdoor air temperature in the air-conditioning apparatus 100 of Embodiment 1 of the present invention.
Figure 15:
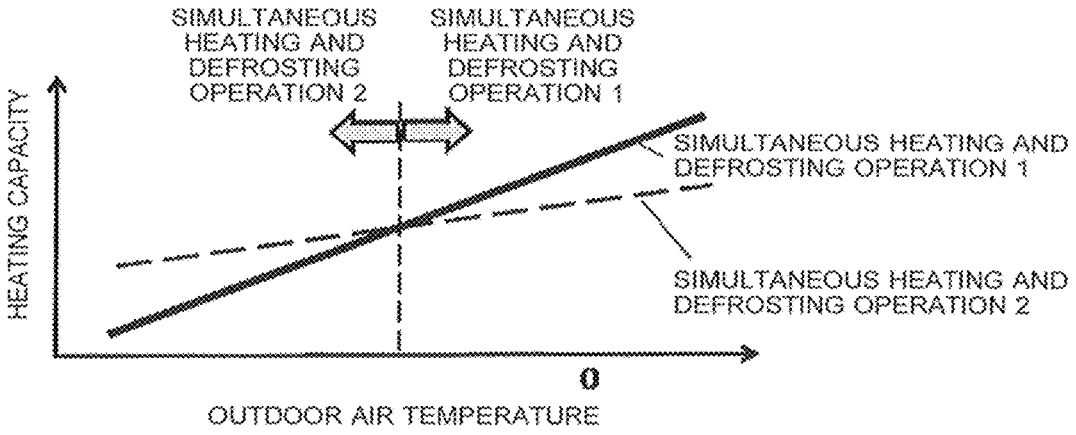
FIG. 15 is a graph for showing a heating capacity of the simultaneous heating and defrosting operation 1 and a heating capacity of the simultaneous heating and defrosting operation 2 in the air-conditioning apparatus 100 of Embodiment 1 of the present invention.

Next, operation characteristics of the simultaneous heating and defrosting operation 1 and the simultaneous heating and defrosting operation 2 are discussed by using FIG. 14 and FIG. 15. FIG. 14 is a graph for showing a heating capacity of the simultaneous heating and defrosting operation 1 to an outdoor air temperature in the air-conditioning apparatus 100 of Embodiment 1. In the graph, the horizontal axis represents outdoor air temperature (degrees Celsius) and the vertical axis represents heating capacity. In the simultaneous heating and defrosting operation 1, the sum of an amount of heat received from outdoor air by a parallel heat exchanger operating as an evaporator and an input of a compressor (the uppermost broken line in the graph) is distributed to a heating capacity of an indoor unit, a defrosting capacity, and an amount of heat transferred to outdoor air. Here, when the outdoor air temperature is 0 degrees Celsius or higher, heat is given from the outdoor air to the frost which is 0 degrees Celsius, and thus an amount of heat transferred to the outdoor air is a negative value. When the amount of heat transferred to the outdoor air is a negative value, the absolute value of the amount of transferred heat can also be referred to as an amount of heat captured from the outdoor air.

As the outdoor air temperature decreases, an amount of heat received from the outdoor air in an evaporator decreases. Meanwhile, an amount of frost at the beginning of defrosting is substantially constant regardless of the outdoor air temperature, and thus the defrosting capacity for melting the frost is substantially constant regardless of the outdoor air temperature as indicated by a gray part in the graph. The sum of the heating capacity of the indoor unit and an amount of heat transferred to the outdoor air is indicated by the second broken line from the top in the graph.

In the simultaneous heating and defrosting operation 1, the outdoor fans **5*f*-1 and 5*f*-2 operate to receive heat from outdoor air by a parallel heat exchanger operating as an evaporator. At this time, the air sent by the outdoor fans 5*f*-1 and 5*f*-2 flows into not only the parallel heat exchanger operating as an evaporator but also a parallel heat exchanger subjected to defrosting. Thus, an amount of heat transferred to outdoor air (or an amount of heat captured from outdoor air) by the parallel heat exchanger increases as a difference between the melting point of frost (0 degrees Celsius) and the outdoor air temperature increases. The heating capacity of the indoor unit in the simultaneous heating and defrosting operation 1** is a value obtained by subtracting the defrosting capacity and the amount of heat transferred to outdoor air from the sum of the amount of heat received from outdoor air by the evaporator and an input of the compressor, and is indicated by a bold line in the graph.

In contrast, in the simultaneous heating and defrosting operation 2, full defrosting is performed in, for example, one of the two heat source units. When the compressors mounted in the two heat source units have the same capacity, the flow rate of refrigerant is half of that in the normal heating operation. However, in the simultaneous heating and defrosting operation 2, unlike in the simultaneous heating and defrosting operation 1, the outdoor fan of the heat source unit subjected to defrosting is stopped. Thus, an influence of the outdoor air temperature on the hating capacity is only the amount of heat received from outdoor air by the evaporator.

FIG. 15 is a graph for showing the heating capacity of the simultaneous heating and defrosting operation 1 and the heating capacity of the simultaneous heating and defrosting operation 2 in the air-conditioning apparatus 100 of Embodiment 1. In the graph, the horizontal axis represents outdoor air temperature (degrees Celsius) and the vertical axis represents heating capacity. As illustrated in FIG. 15, the slope of change in heating capacity relative to the outdoor air temperature in the simultaneous heating and defrosting operation 2 is smaller than the slope of change in heating capacity relative to the outdoor air temperature in the simultaneous heating and defrosting operation 1. Thus, when the outdoor air temperature becomes lower than a predetermined threshold temperature, the heating capacity of the simultaneous heating and defrosting operation 2 becomes higher than the heating capacity of the simultaneous heating and defrosting operation 1. The threshold temperature is in a region of an outdoor air temperature of 0 degrees Celsius or less and is included in a temperature range of from about −10 degrees Celsius to about −2 degrees Celsius. However, this threshold temperature may slightly vary according to a system configuration.

Thus, a threshold temperature may be set in advance within a temperature range of −10 degrees Celsius to −2 degrees Celsius, and when it is determined that defrosting is necessary, any one of the simultaneous heating and defrosting operation 1 and the simultaneous heating and defrosting operation 2 may be selected on the basis of the outdoor air temperature. For example, when the controller 30 determines that defrosting needs to be performed during the normal heating operation, the controller 30 performs the simultaneous heating and defrosting operation 1 in a case in which the outdoor air temperature is equal to or higher than the threshold temperature, and the controller 30 performs the simultaneous heating and defrosting operation 2 in a case in which the outdoor air temperature is lower than the threshold temperature.

When a blockage occurs in an outdoor heat exchanger due to frosting, for example, the suction pressure decreases. Thus, the controller 30 may perform the simultaneous heating and defrosting operation 2 when the suction pressure during the heating operation is lower than a value set in advance.

As described above, in Embodiment 1, an operation for acquiring a higher heating capacity can be selected to be performed from the simultaneous heating and defrosting operation 1, in which defrosting can be performed at a low refrigerant flow rate by using condensation latent heat of refrigerant, and the simultaneous heating and defrosting operation 2, in which an amount of heat transferred to outdoor air can be decreased by stopping an outdoor fan, in the case of performing a medium-pressure defrosting operation. Thus, according to Embodiment 1, a decrease in heating capacity in a simultaneous heating and defrosting operation can be suppressed.

Embodiment 2

Figure 16:
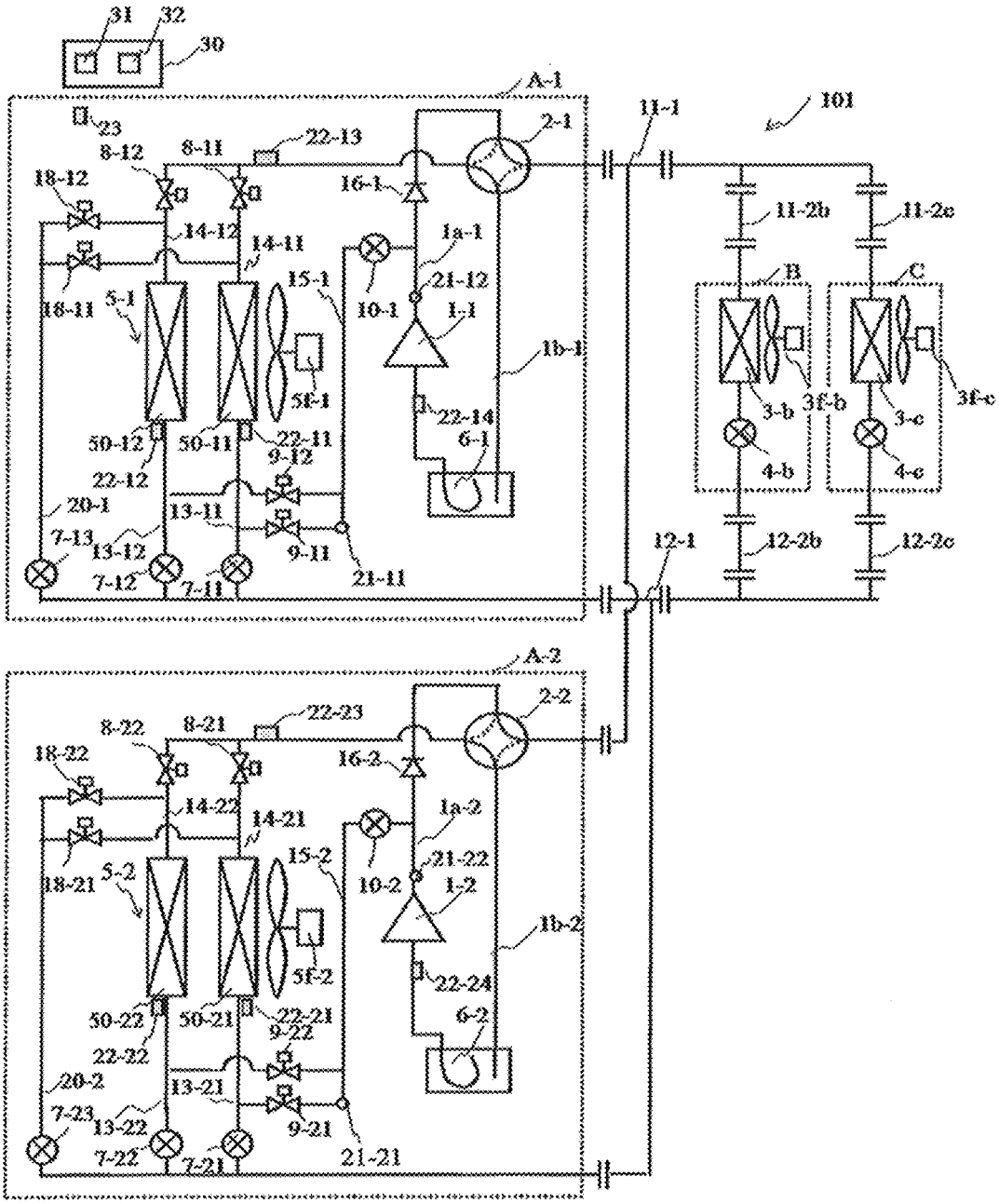
FIG. 16 is a circuit configuration diagram for illustrating the configuration of an air-conditioning apparatus 101 of Embodiment 2 of the present invention.

An air-conditioning apparatus of Embodiment 2 of the present invention is described. FIG. 16 is a circuit configuration diagram for illustrating the configuration of an air-conditioning apparatus 101 of Embodiment 2. As illustrated in FIG. 16, Embodiment 2 is different from Embodiment 1 in an inlet and an outlet for refrigerant to a parallel heat exchanger subjected to defrosting.

In the heat source unit A-1, one end of the defrosting pipe 15-1 is connected to the discharge pipe **1*a*-1, and the other end thereof branches off to be connected to the first connection pipes 13-11 and 13-12**.

In addition, the heat source unit A-1 is provided with a defrosting pipe 20-1 different from the defrosting pipe 15-1. One end of the defrosting pipe 20-1 is connected to both an upstream side, in a flow of refrigerant in the normal heating operation, of the second expansion device 7-11 in the first connection pipe 13-11 and an upstream side, in a flow of refrigerant in the normal heating operation, of the second expansion device 7-12 in the first connection pipe 13-12. The other end of the defrosting pipe 20-1 branches off to be connected to the second connection pipes 14-11 and 14-12. The defrosting pipe 20-1 is provided with the second expansion device 7-13. The pipes branched at the other end of the defrosting pipe 20-1 are respectively provided with third solenoid valves 18-11 and 18-12.

The heat source unit A-2 has a configuration similar to that of the heat source unit A-1. That is, third solenoid valves 18-21 and 18-22 and a defrosting pipe 20-2 of the heat source unit A-2 correspond to the third solenoid valves 18-11 and 18-12 and the defrosting pipe 20-1 of the heat source unit A-1, respectively.

Figure 17:
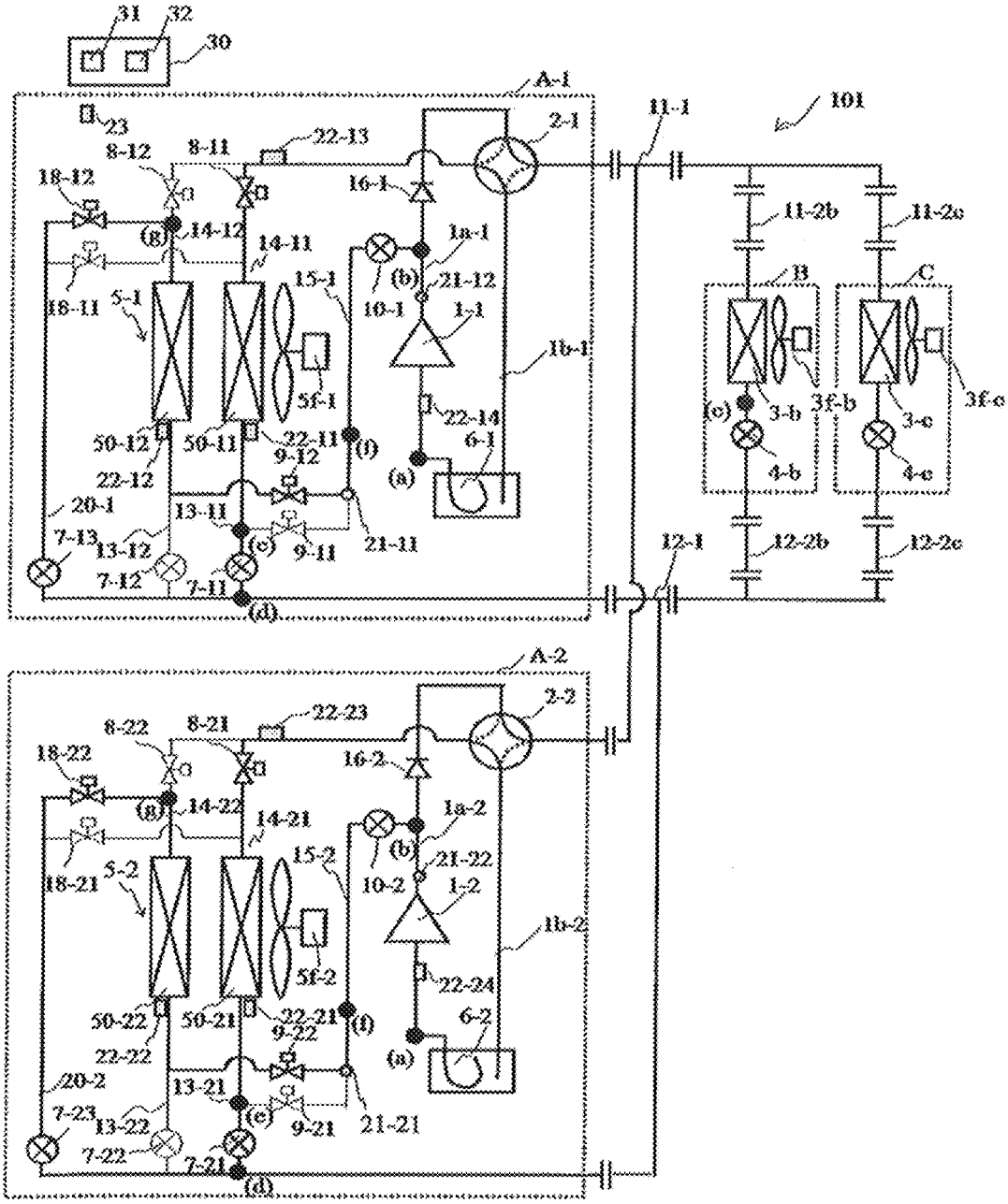
FIG. 17 is a diagram for illustrating a flow of refrigerant during the simultaneous heating and defrosting operation 1 of the air-conditioning apparatus 101 of Embodiment 2 of the present invention.
Figure 18:
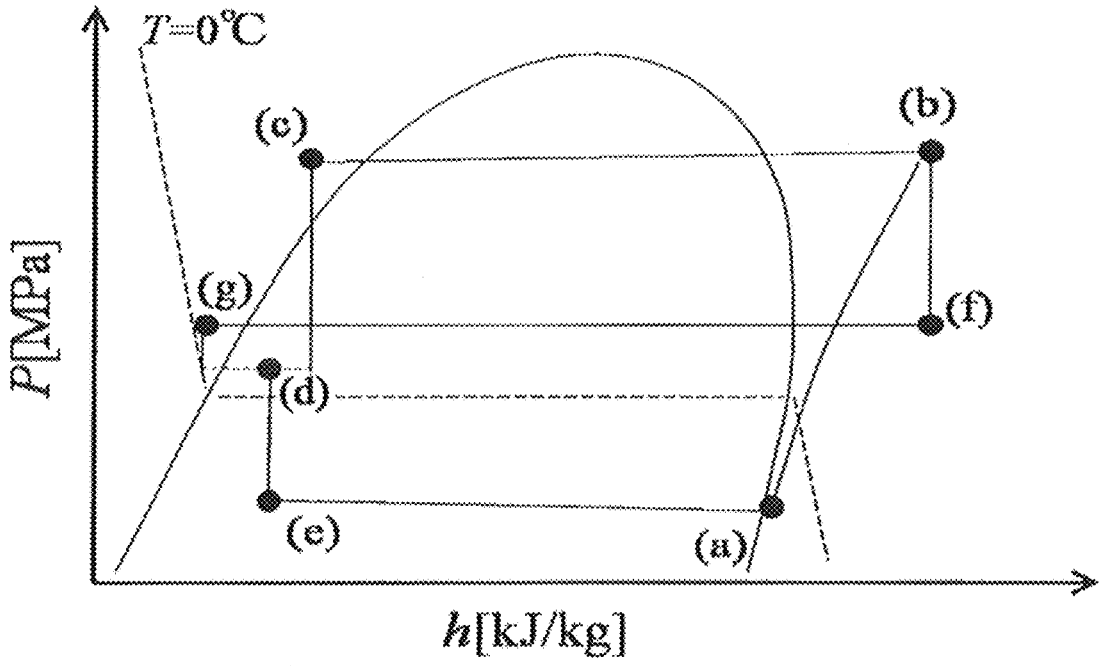
FIG. 18 is a P-h chart during the simultaneous heating and defrosting operation 1 of the air-conditioning apparatus 101 of Embodiment 2 of the present invention.

FIG. 17 is a diagram for illustrating a flow of refrigerant during the simultaneous heating and defrosting operation 1 of the air-conditioning apparatus 101 of Embodiment 2. In FIG. 17, a portion in which refrigerant flows is indicated by a bold line, and a portion in which no refrigerant flows is indicated by a thin line. FIG. 18 is a P-h chart during the simultaneous heating and defrosting operation 1 of the air-conditioning apparatus 101 of Embodiment 2. The points (a) to (g) in FIG. 18 indicate states of refrigerant in portions (a) to (g) in FIG. 17, respectively.

When the controller 30 determines that defrosting for resolving a frosted state of a parallel heat exchanger (for example, the parallel heat exchanger 50-12) needs to be performed and selects the simultaneous heating and defrosting operation 1 while the normal heating operation is being performed, the controller 30 performs control to fully open the first solenoid valve 8-12 and the second expansion device 7-12 corresponding to the parallel heat exchanger subjected to defrosting. In addition, the controller 30 performs control to open the second solenoid valve 9-12 and the third solenoid valve 18-12 corresponding to the parallel heat exchanger 50-12 subjected to defrosting and to set the opening degree of the first expansion device 10-1 to an opening degree set in advance. Furthermore, the controller 30 controls the opening degree of the second expansion device 7-13 so that the pressure of the refrigerant having flowed out of the second expansion device 7-13 approaches the pressure of the refrigerant in a main circuit that joins at portion (d) in FIG. 17.

Accordingly, a defrosting circuit in which the compressor 1-1, the first expansion device 10-1, the second solenoid valve 9-12, the parallel heat exchanger 50-12, the third solenoid valve 18-12, and the second expansion device 7-13 are sequentially connected is formed in addition to the main circuit. Meanwhile, the parallel heat exchanger 50-11 operates as an evaporator of the main circuit as in the normal heating operation. Accordingly, the simultaneous heating and defrosting operation 1 is performed.

In the simultaneous heating and defrosting operation 1 of Embodiment 2, the heat source unit A-2 is controlled to be operated symmetrically to the heat source unit A-1. That is, in the heat source unit A-2, a defrosting circuit including one of the parallel heat exchangers 50-21 and 50-22 is formed, and the other of the parallel heat exchangers 50-21 and 50-22 operates as an evaporator of a main circuit.

Figure 19:
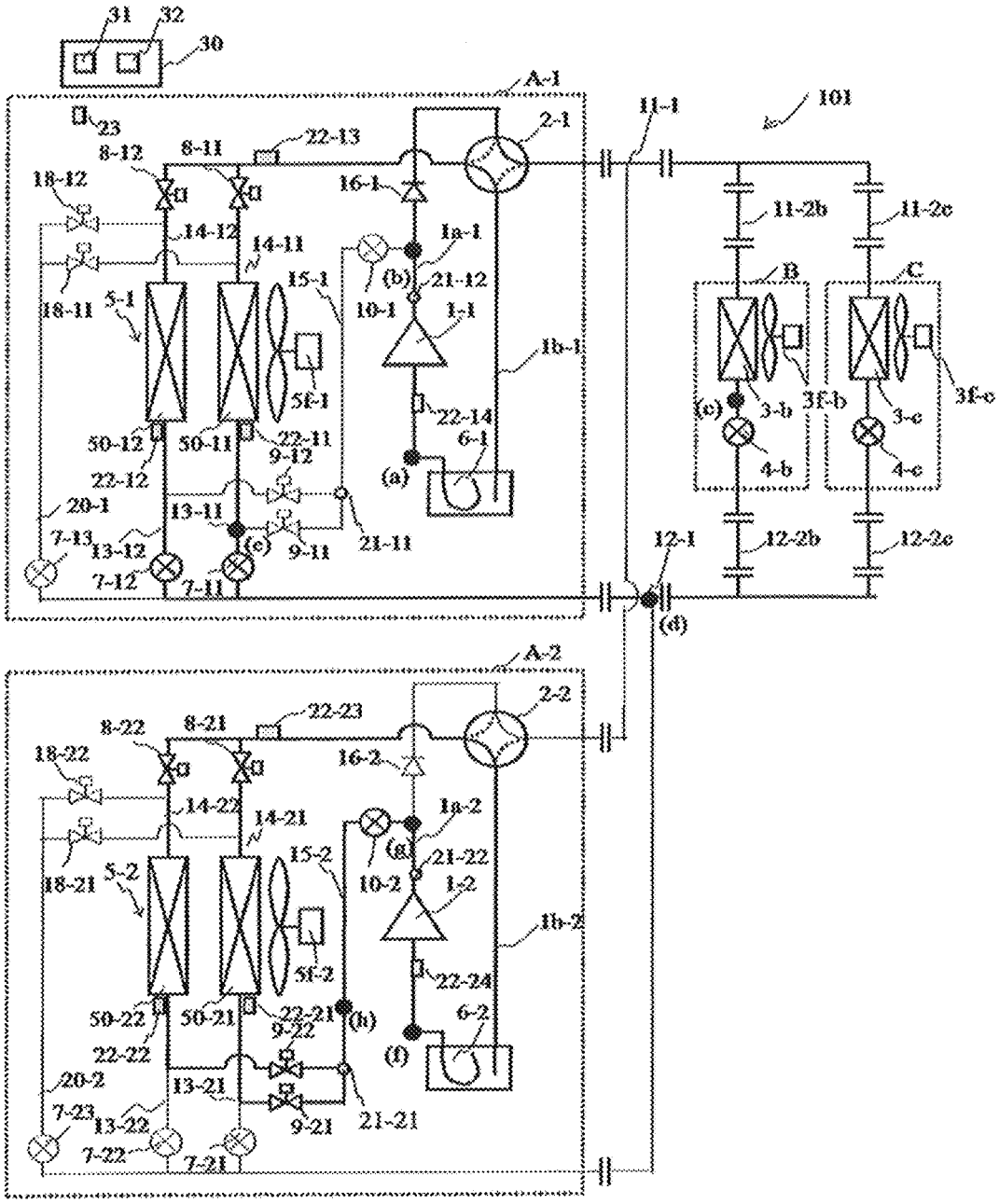
FIG. 19 is a diagram for illustrating a flow of refrigerant during the simultaneous heating and defrosting operation 2 of the air-conditioning apparatus 101 of Embodiment 2 of the present invention.
Figure 20:
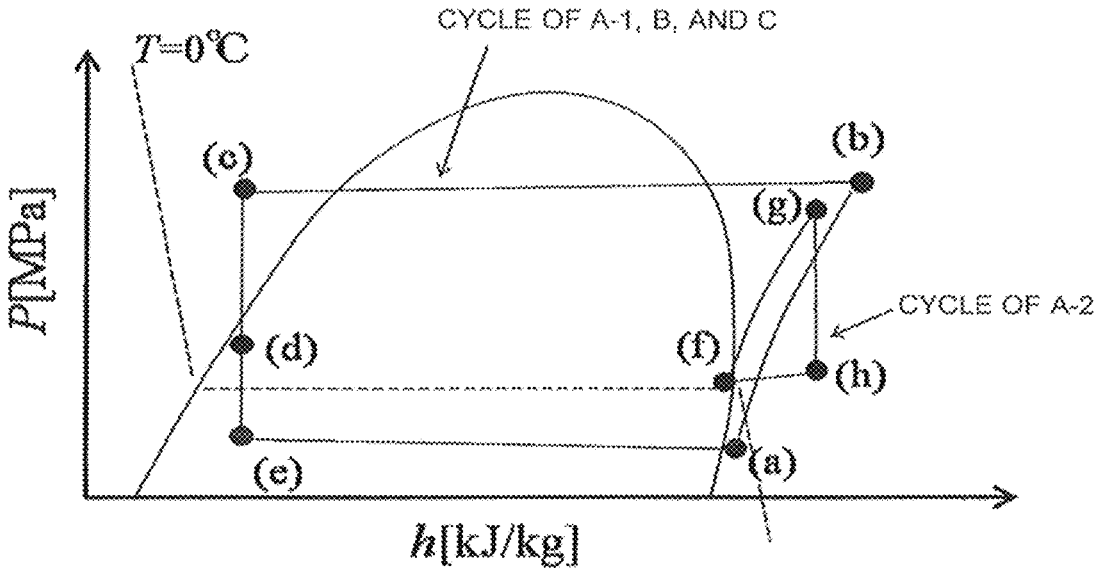
FIG. 20 is a P-h chart during the simultaneous heating and defrosting operation 2 of the air-conditioning apparatus 101 of Embodiment 2 of the present invention.

FIG. 19 is a diagram for illustrating a flow of refrigerant during the simultaneous heating and defrosting operation 2 of the air-conditioning apparatus 101 of Embodiment 2. In FIG. 19, a portion in which refrigerant flows is indicated by a bold line, and a portion in which no refrigerant flows is indicated by a thin line. FIG. 20 is a P-h chart during the simultaneous heating and defrosting operation 2 of the air-conditioning apparatus 101 of Embodiment 2. The points (a) to (h) in FIG. 20 indicate states of refrigerant in portions (a) to (h) in FIG. 19, respectively. The points (a) to (e) in FIG. 20 indicate a cycle of a main circuit formed of the heat source unit A-1 and the indoor units B and C, and the points (f) to (h) indicate a cycle of a defrosting circuit formed of the heat source unit A-2.

When the controller 30 determines that defrosting for resolving a frosted state of a parallel heat exchanger needs to be performed and selects the simultaneous heating and defrosting operation 2 while the normal heating operation is being performed, the controller 30 performs control to fully open the second expansion devices 7-21 and 7-22 and the third solenoid valves 18-21 and 18-22 of a heat source unit subjected to defrosting (in this example the heat source unit A-2). In addition, the controller 30 performs control to open the first solenoid valves 8-21 and 8-22 and the second solenoid valves 9-21 and 9-22. Furthermore, the controller 30 controls the opening degree of the first expansion device 10-2 so that the discharge pressure of the compressor 1-2 does not exceed the pressure of the first extension pipe 11-1.

Accordingly, two defrosting circuits connected in parallel to each other are formed while being disconnected from the main circuit. In a first defrosting circuit, the compressor 1-2, the first expansion device 10-2, the second solenoid valve 9-21, the parallel heat exchanger 50-21, the first solenoid valve 8-21, the cooling/heating switching device 2-2, and the accumulator 6-2 are sequentially and circularly connected. In a second defrosting circuit, the compressor 1-2, the first expansion device 10-2, the second solenoid valve 9-22, the parallel heat exchanger 50-22, the first solenoid valve 8-22, the cooling/heating switching device 2-2, and the accumulator 6-2 are sequentially and circularly connected.

In the simultaneous heating and defrosting operation 1, a flow of refrigerant and a flow of air are opposed to each other in the configuration of Embodiment 1 described above, but a flow of refrigerant and a flow of air are parallel to each other in the configuration of Embodiment 2. Accordingly, heat transferred to air can be given to frost on a downstream side in a flow of air, and thus defrosting efficiency can further be increased.

In the simultaneous heating and defrosting operation 2, the two parallel heat exchangers 50-21 and 50-22 are connected in series in the defrosting circuit in the configuration of Embodiment 1 described above, but the two parallel heat exchangers 50-21 and 50-22 can be connected in parallel in the defrosting circuit in the configuration of Embodiment 2. Thus, according to Embodiment 2, refrigerant for defrosting can flow into the parallel heat exchangers 50-21 and 50-22 in parallel, and thus pressure loss of refrigerant in the simultaneous heating and defrosting operation 2 can be reduced.

Embodiment 3

Figure 21:
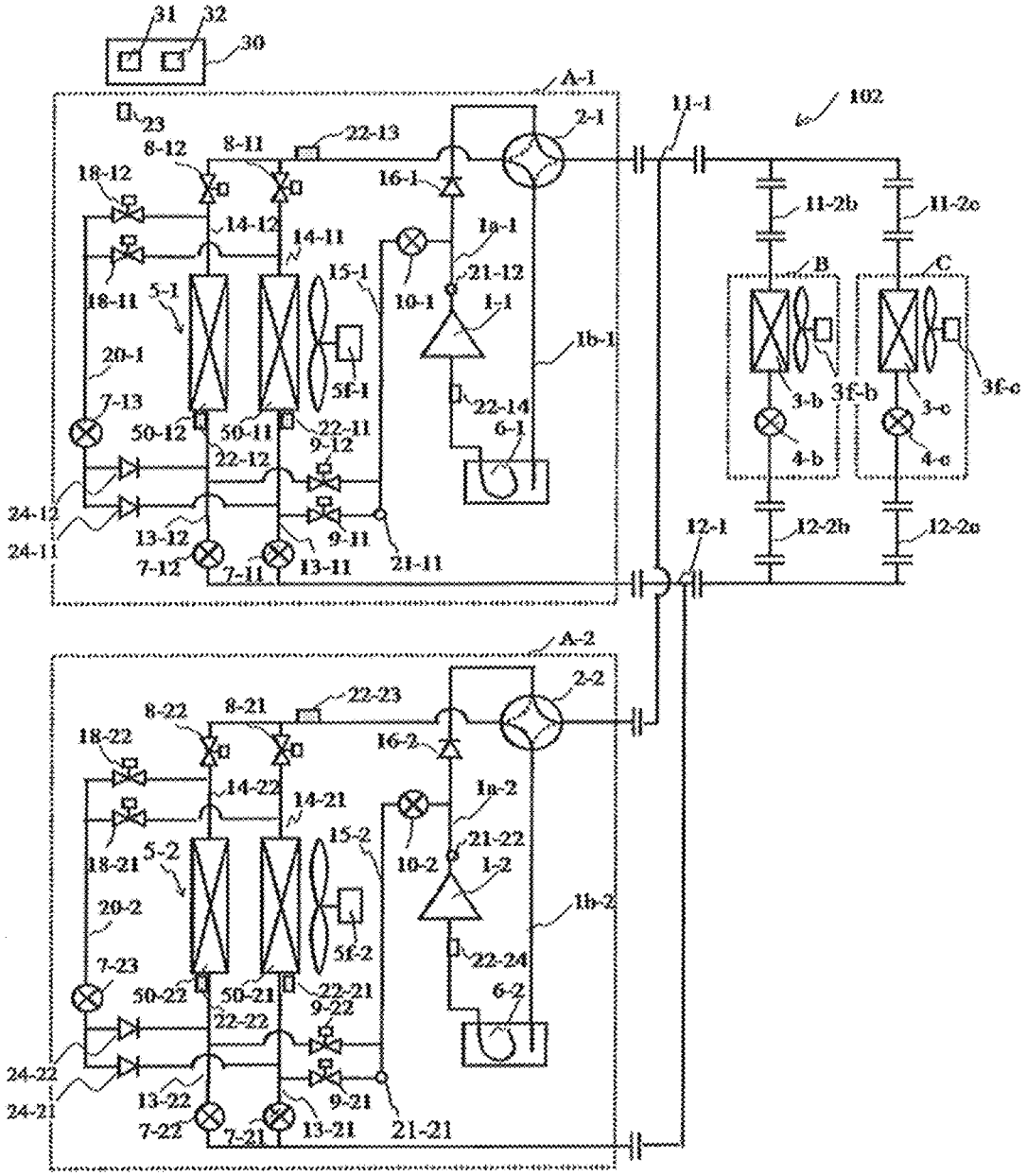
FIG. 21 is a circuit configuration diagram for illustrating the configuration of an air-conditioning apparatus 102 of Embodiment 3 of the present invention.

An air-conditioning apparatus of Embodiment 3 of the present invention is described. FIG. 21 is a circuit configuration diagram for illustrating the configuration of an air-conditioning apparatus 102 of Embodiment 3. As illustrated in FIG. 21, Embodiment 3 is different from Embodiment 2 in the position where the refrigerant of a defrosting circuit having flowed out of a parallel heat exchanger subjected to defrosting (for example, the parallel heat exchanger 50-12) and the refrigerant of a main circuit returned from the indoor units B and C to a heat source unit (for example, the heat source unit A-1) join together in the simultaneous heating and defrosting operation 1.

In the heat source unit A-1, one end of the defrosting pipe 20-1 branches off to be connected to a downstream side, in a flow of refrigerant in the normal heating operation, of the second expansion device 7-11 in the first connection pipe 13-11 and a downstream side, in a flow of refrigerant in the normal heating operation, of the second expansion device 7-12 in the first connection pipe 13-12. The other end of the defrosting pipe 20-1 branches into pipes, which are provided with check valves 24-11 and 24-12, respectively. The check valves 24-11 and 24-12 allow flows of refrigerant from the defrosting pipe 20-1 toward the first connection pipes 13-11 and 13-12 and prevent flows of refrigerant from the first connection pipes 13-11 and 13-12 toward the defrosting pipe 20-1.

The heat source unit A-2 has a configuration similar to that of the heat source unit A-1. That is, check valves 24-21 and 24-22 of the heat source unit A-2 correspond to the check valves 24-11 and 24-12 of the heat source unit A-1.

In Embodiment 3, in the simultaneous heating and defrosting operation 1, the refrigerant that is decompressed by the second expansion device 7-13 of the heat source unit A-1 and flows out of the defrosting pipe 20-1 enters the main circuit on a downstream side of the second expansion devices 7-11 and 7-12. Similarly, the refrigerant that is decompressed by the second expansion device 7-23 of the heat source unit A-2 and flows out of the defrosting pipe 20-2 enters the main circuit on a downstream side of the second expansion devices 7-21 and 7-22. Accordingly, the P-h chart during the simultaneous heating and defrosting operation 1 is similar to the P-h chart of Embodiment 1 illustrated in FIG. 11. Thus, the controllability of the second expansion devices 7-13 and 7-23 increases.

Embodiment 4

Figure 22:
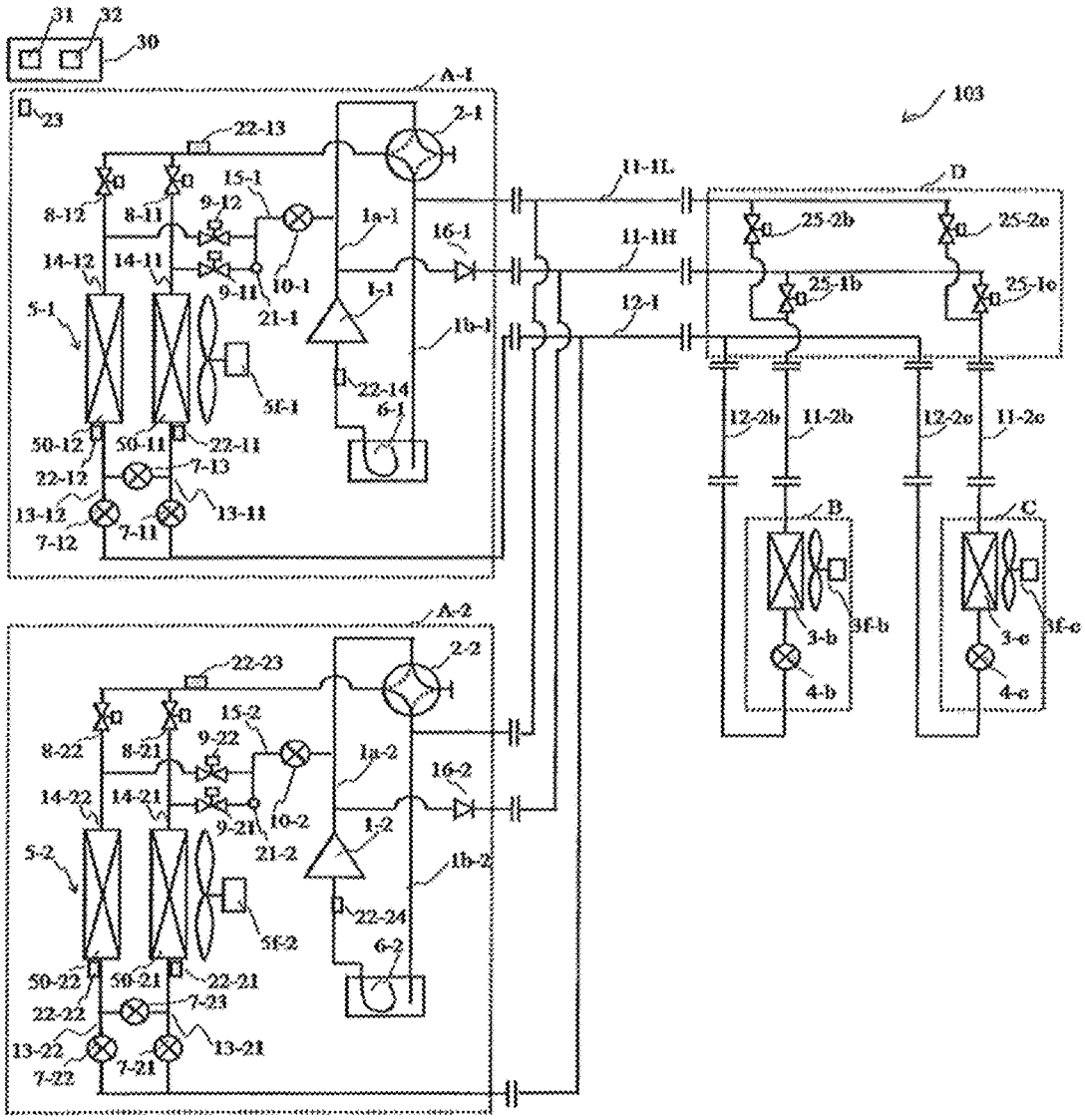
FIG. 22 is a circuit configuration diagram for illustrating the configuration of an air-conditioning apparatus 103 of Embodiment 4 of the present invention.

An air-conditioning apparatus of Embodiment 4 of the present invention is described. FIG. 22 is a circuit configuration diagram for illustrating the configuration of an air-conditioning apparatus 103 of Embodiment 4. As illustrated in FIG. 22, a refrigerant circuit of the air-conditioning apparatus 103 is connected to the plurality of indoor units B and C which are capable of independently selecting a heating operation or a cooling operation. That is, the air-conditioning apparatus 103 has a configuration capable of performing a simultaneous cooling and heating operation. In the refrigerant circuit, a relay unit D is provided between the heat source units A-1 and A-2 and the indoor units B and C. The simultaneous cooling and heating operation can be performed when the number of indoor units is two or more, and hence three or more indoor units may be connected in parallel to the refrigerant circuit.

The heat source units A-1 and A-2 are installed outside a building in usual cases, whereas the indoor units B and C are installed indoors in usual cases. The relay unit D is installed in, for example, a machine room or another room of a building away from the heat source units A-1 and A-2 and the indoor units B and C. The heat source units A-1 and A-2 are connected to the relay unit D through first extension pipes 11-1H and 11-1L and the second extension pipe 12-1. The relay unit D is connected to the indoor unit B through the first extension pipe 11-2*b* and the second extension pipe 12-2*b*. The relay unit D is connected to the indoor unit C through the first extension pipe 11-2*c* and the second extension pipe 12-2*c*. Each of the first extension pipes 11-1H and 11-1L and the second extension pipe 12-1 branches off to be connected to the heat source units A-1 and A-2. The branch portion of each of the first extension pipes 11-1H and 11-1L and the second extension pipe 12-1 may be provided in the middle of the extension pipe as illustrated in FIG. 22 or may be accommodated in any one of the heat source unit A-1 and A-2 or in the relay unit D.

In Embodiment 4, unlike in Embodiments 1 to 3 described above, the first extension pipe 11-1 is formed of the first extension pipe 11-1H and the first extension pipe 11-1L. The first extension pipe 11-1H is a high-pressure gas pipe connected to the discharge pipes 1*a*-1 and 1*a*-2 of the compressors 1-1 and 1-2. The first extension pipe 11-1L is a low-pressure gas pipe connected to the suction pipes 1*b*-1 and 1*b*-2 of the compressors 1-1 and 1-2. The first extension pipe 11-1H and the first extension pipe 11-1L are connected to gas-side pipes of the indoor units B and C through a flow switching device, which are described below. The second extension pipe 12-1 is a liquid pipe similar to that in Embodiments 1 to 3 described above.

The relay unit D accommodates switching valves 25-1*b*, 25-2*b*, 25-1*c*, and 25-2*c* serving as a flow switching device. The switching valves 25-1*b*, 25-2*b*, 25-1*c*, and 25-2*c* open or close flow passages under control of the controller 30, thereby switching the operation modes of the respective indoor units between the cooling operation and the heating operation.

The switching valve 25-1*b* opens or closes a flow passage between the first extension pipe 11-1H and the first extension pipe 11-2*b*. The switching valve 25-2*b* opens or closes a flow passage between the first extension pipe 11-1L and the first extension pipe 11-2*b*. When the switching valve 25-1*b* is opened and the switching valve 25-2*b* is closed, high-pressure gas refrigerant discharged from the compressors 1-1 and 1-2 flows into the first extension pipe 11-2*b* connected to the indoor unit B. Accordingly, the heating operation is performed in the indoor unit B. Meanwhile, when the switching valve 25-1*b* is closed and the switching valve 25-2*b* is opened, low-pressure gas refrigerant to be sucked into the compressors 1-1 and 1-2 flows into the first extension pipe 11-2*b*. Accordingly, the cooling operation is performed in the indoor unit B.

The switching valve 25-1*c* opens or closes a flow passage between the first extension pipe 11-1H and the first extension pipe 11-2*c*. The switching valve 25-2*c* opens or closes a flow passage between the first extension pipe 11-1L and the first extension pipe 11-2*c*. When the switching valve 25-1*c* is opened and the switching valve 25-2*c* is closed, high-pressure gas refrigerant discharged from the compressors 1-1 and 1-2 flows into the first extension pipe 11-2*c* connected to the indoor unit C. Accordingly, the heating operation is performed in the indoor unit C. Meanwhile, when the switching valve 25-1*c* is closed and the switching valve 25-2*c* is opened, low-pressure gas refrigerant to be sucked into the compressors 1-1 and 1-2 flows into the first extension pipe 11-2*c*. Accordingly, the cooling operation is performed in the indoor unit C.

In Embodiment 4, with the above-described configuration, a simultaneous cooling and heating operation (for example, a cooling main operation or a heating main operation) in which an indoor unit performing a cooling operation and an indoor unit performing a heating operation are present at the same time can be performed in addition to a cooling only operation and a heating only operation similar to those in Embodiments 1 to 3.

In the heating only operation and the heating main operation in which the outdoor heat exchangers 5-1 and 5-2 operate as evaporators, the fins 5*b* of the outdoor heat exchangers 5-1 and 5-2 may become frosted. When the controller 30 determines that defrosting of the outdoor heat exchangers 5-1 and 5-2 needs to be performed while the heating only operation is being performed, the controller 30 performs the simultaneous heating and defrosting operation 1 or the simultaneous heating and defrosting operation 2 as in Embodiments 1 to 3 while continuing the heating only operation. When the controller 30 determines that defrosting of the outdoor heat exchangers 5-1 and 5-2 needs to be performed while the heating main operation is being performed, the controller 30 performs the simultaneous heating and defrosting operation 1 or the simultaneous heating and defrosting operation 2 as in Embodiments 1 to 3 while continuing the heating main operation. In particular, while the heating main operation is being performed, there is an indoor unit performing a cooling operation (that is, an indoor unit including an indoor heat exchanger that operates as an evaporator and receives heat from indoor air), and thus defrosting can be efficiently performed while an exhaust heat recovery operation is being performed.

Embodiment 5

Figure 23:
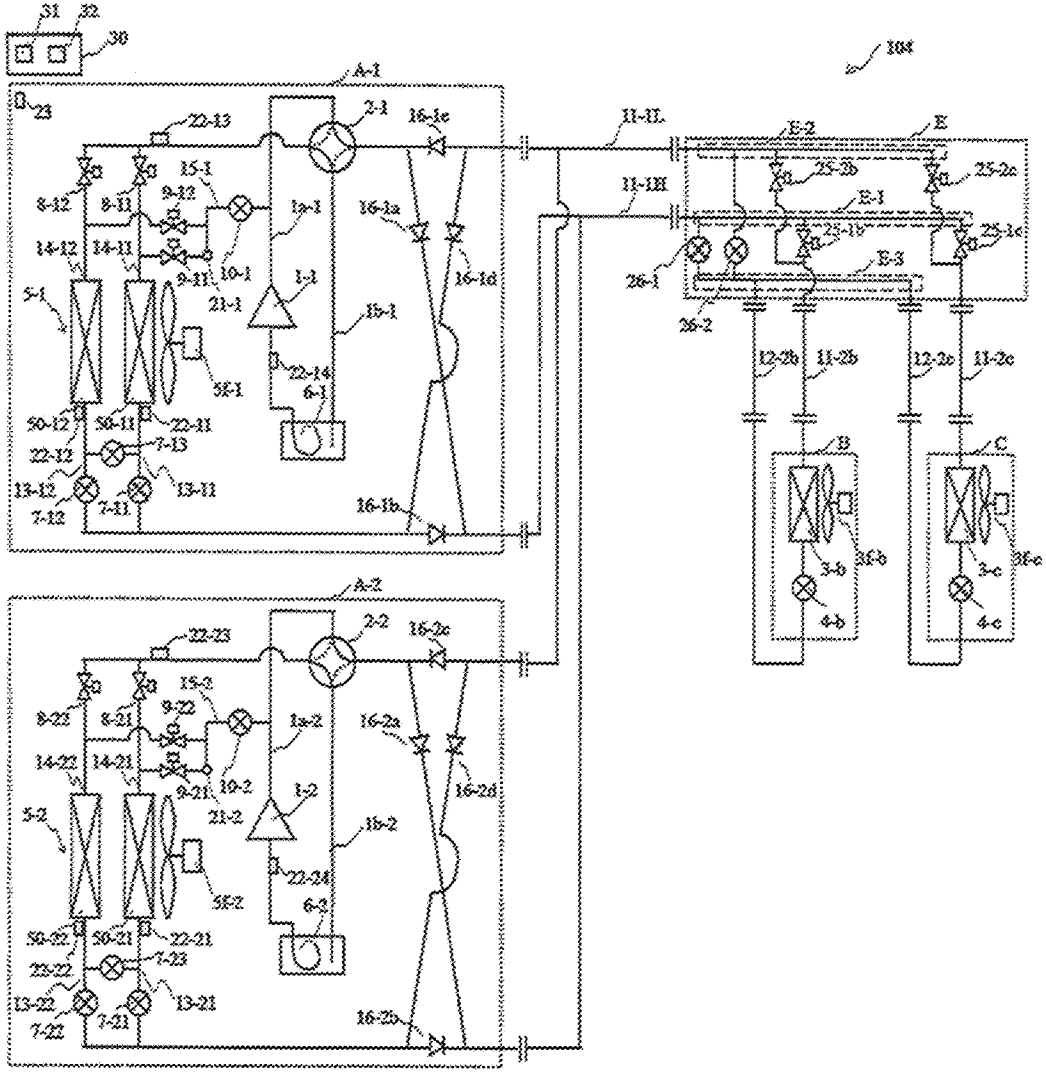
FIG. 23 is a circuit configuration diagram for illustrating the configuration of an air-conditioning apparatus 104 of Embodiment 5 of the present invention.

An air-conditioning apparatus of Embodiment 5 of the present invention is described. FIG. 23 is a circuit configuration diagram for illustrating the configuration of an air-conditioning apparatus 104 of Embodiment 5. As illustrated in FIG. 23, a refrigerant circuit of the air-conditioning apparatus 104 is connected to the plurality of indoor units B and C which are capable of independently selecting a heating operation or a cooling operation. That is, the air-conditioning apparatus 104 has a configuration capable of performing a simultaneous cooling and heating operation. As in Embodiment 4 described above, in the refrigerant circuit, the relay unit D is provided between the heat source units A-1 and A-2 and the indoor units B and C. The simultaneous cooling and heating operation can be performed when the number of indoor units is two or more, and hence three or more indoor units may be connected in parallel to the refrigerant circuit.

In Embodiment 4 described above and Embodiment 5, an indoor unit performing a heating operation and an indoor unit performing a cooling operation are connected in series to each other in a flow of refrigerant during the simultaneous cooling and heating operation. That is, refrigerant passes through the indoor unit performing the heating operation and is condensed to liquid refrigerant while heating indoor air, and then passes through the indoor unit performing the cooling operation and evaporates to gas refrigerant while cooling indoor air. Accordingly, exhaust heat recovery can be performed, and operation can be efficiently performed.

Here, when a heating load is larger than the sum of a cooling load and input of a compressor, an outdoor heat exchanger operates as an evaporator because it is necessary to collect heat from outside air. When the heating load is smaller than the sum of the cooling load and the input of the compressor, the outdoor heat exchanger operates as a condenser because it is necessary to discharge heat to outside air.

Embodiment 4 described above and Embodiment 5 are different from each other in the method of connecting an outdoor heat exchanger to an indoor unit performing a heating operation and an indoor unit performing a cooling operation.

In Embodiment 4 described above, when an outdoor heat exchanger operates as a condenser, the outdoor heat exchanger is connected in parallel to an indoor unit performing a heating operation, and refrigerant condensed in individual heat exchangers joins together. Then, the joined refrigerant is supplied to an indoor unit performing a cooling operation. When an outdoor heat exchanger operates as an evaporator, the outdoor heat exchanger is connected in parallel to an indoor unit performing a cooling operation, and refrigerant condensed in an indoor unit performing a heating operation is branched into refrigerant. Then, the refrigerant is supplied to the indoor unit performing a cooling operation and the outdoor heat exchanger.

Meanwhile, in Embodiment 5, when an outdoor heat exchanger operates as a condenser, the outdoor heat exchanger is connected in series to an upstream side of an indoor unit performing a heating operation, and refrigerant condensed by the outdoor heat exchanger and the indoor unit performing a heating operation is supplied to an indoor unit performing a cooing operation. When an outdoor heat exchanger operates as an evaporator, the outdoor heat exchanger is connected in series to a downstream side of an indoor unit performing a cooling operation. Then, refrigerant condensed by an indoor unit performing a heating operation passes through the indoor unit performing a cooling operation, is supplied to the outdoor heat exchanger, completes evaporation, and is sucked into a compressor.

The heat source unit A-1 is provided with check valves 16-1*a*, 16-1*b*, 16-1*c*, and 16-1*d*. The check valve 16-1*a* is provided in a refrigerant pipe connecting the cooling/heating switching device 2-1 and the first extension pipe 11-1H and allows only flowing of refrigerant from the cooling/heating switching device 2-1 toward the first extension pipe 11-1H. The check valve 16-1*b* is provided in a refrigerant pipe connecting the outdoor heat exchanger 5-1 and the first extension pipe 11-1H and allows only flowing of refrigerant from the outdoor heat exchanger 5-1 toward the first extension pipe 11-1H. The check valve 16-1*c* is provided in a refrigerant pipe connecting the cooling/heating switching device 2-1 and the first extension pipe 11-1L and allows only flowing of refrigerant from the first extension pipe 11-1L toward the cooling/heating switching device 2-1. The check valve 16-1*d* is provided in a refrigerant pipe connecting the outdoor heat exchanger 5-1 and the first extension pipe 11-1L and allows only flowing of refrigerant from the first extension pipe 11-1L toward the outdoor heat exchanger 5-1.

The outdoor heat exchanger 5-1 operates as a condenser or an evaporator in accordance with switching of a flow passage by the cooling/heating switching device 2-1. With the check valves 16-1*a*, 16-1*b*, 16-1*c*, and 16-1*d* being provided as described above, refrigerant flows from the heat source unit A-1 toward a relay unit E in the first extension pipe 11-1H, and refrigerant flows from the relay unit E toward the heat source unit A-1 in the first extension pipe 11-1L in both cases where the outdoor heat exchanger 5-1 operates as a condenser and where the outdoor heat exchanger 5-1 operates as an evaporator.

The heat source unit A-2 has a configuration similar to that of the heat source unit A-1. That is, check valves 16-2*a*, 16-2*b*, 16-2*c*, and 16-2*d* of the heat source unit A-2 correspond to the check valves 16-1*a*, 16-1*b*, 16-1*c*, and 16-1*d* of the heat source unit A-1, respectively.

The relay unit E is provided with a first branch portion E-1, a second branch portion E-2, and a third branch portion E-2. The first branch portion E-1 is connected to the first extension pipe 11-1H and the first extension pipes 11-2*b* and 11-2*c*. High-pressure refrigerant flows through the first branch portion E-1. The second branch portion E-2 is connected to the first extension pipe 11-1L and the first extension pipes 11-2*b* and 11-2*c*. Low-pressure refrigerant flows through the second branch portion E-2. The third branch portion E-2 is connected to the first branch portion E-1, the second branch portion E-2, and the second extension pipes 12-2*b* and 12-2*c*. Medium-pressure refrigerant, which has a pressure between a high pressure and a low pressure, flows through the third branch portion E-2.

A refrigerant pipe connecting the first branch portion E-1 and the third branch portion E-2 is provided with a third expansion device 26-1. A refrigerant pipe connecting the second branch portion E-2 and the third branch portion E-2 is provided with a fourth expansion device 26-2. The third expansion device 26-1 and the fourth expansion device 26-2 are each formed of, for example, an electronic expansion valve. The third expansion device 26-1 and the fourth expansion device 26-2 are capable of changing their opening degrees in response to an instruction from the controller 30. The third expansion device 26-1 and the fourth expansion device 26-2 are accommodated in the relay unit E.

In addition, the relay unit E is provided with switching valves 25-1*b*, 25-2*b*, 25-1*c*, and 25-2*c* similar to those in Embodiment 4 described above.

Also in Embodiment 5, as in Embodiment 4 described above, the fins 5*b* of the outdoor heat exchangers 5-1 and 5-2 may be frosted in a heating only operation and a heating main operation in which the outdoor heat exchangers 5-1 and 5-2 operate as evaporators. When the controller 30 determines that defrosting of the outdoor heat exchangers 5-1 and 5-2 needs to be performed while the heating only operation is being performed, the controller 30 performs the simultaneous heating and defrosting operation 1 or the simultaneous heating and defrosting operation 2 as in Embodiments 1 to 3 while continuing the heating only operation. When the controller 30 determines that defrosting of the outdoor heat exchangers 5-1 and 5-2 needs to be performed while the heating main operation is being performed, the controller 30 performs the simultaneous heating and defrosting operation 1 or the simultaneous heating and defrosting operation 2 as in Embodiments 1 to 3 while continuing the heating main operation. In particular, while the heating main operation is being performed, there is an indoor unit performing a cooling operation, and thus defrosting can be efficiently performed while an exhaust heat recovery operation is being performed.

As described above, the refrigeration cycle apparatus according to Embodiments described above includes the main circuit configured to circulate refrigerant, the plurality of heat source units A-1 and A-2 connected in parallel to each other in the main circuit, and the controller 30 configured to control the plurality of heat source units A-1 and A-2. Each of the plurality of heat source units A-1 and A-2 includes the compressor (for example, the compressor 1-1) configured to compress and discharge refrigerant, the plurality of parallel heat exchangers (for example, the parallel heat exchangers 50-11 and 50-12) connected in parallel to each other in a flow of refrigerant and configured to operate at least as evaporators, the check valve (for example, the check valve 16-1) configured to prevent backflow of the refrigerant discharged from the compressor, the defrosting circuit (for example, the defrosting pipe 15-1) configured to branch the refrigerant discharged from the compressor on the upstream side of the check valve and supply the refrigerant to at least one or some parallel heat exchangers among the plurality of parallel heat exchangers, and the first flow switching device (for example, the first solenoid valves 8-11 and 8-12, the second solenoid valves 9-11 and 9-12, or the second expansion devices 7-11, 7-12, and 7-13) configured to switch the flow passage of refrigerant passing through the plurality of parallel heat exchangers. The controller 30 switches between and performs the first simultaneous heating and defrosting operation (the simultaneous heating and defrosting operation 1) of, in at least one or some heat source units (for example, all the heat source units A-1 and A-2) among the plurality of heat source units, supplying part of the refrigerant discharged from the compressor to one or some parallel heat exchangers (for example, the parallel heat exchangers 50-12 and 50-22) among the plurality of parallel heat exchangers through the defrosting circuit and allowing the other one or more parallel heat exchangers (for example, the parallel heat exchangers 50-11 and 50-21) among the plurality of parallel heat exchangers to operate as evaporators, and the second simultaneous heating and defrosting operation (the simultaneous heating and defrosting operation 2) of, in one or some heat source units (for example, the heat source unit A-2) among the plurality of heat source units, supplying the refrigerant discharged from the compressor is supplied to all the plurality of parallel heat exchangers (for example, the parallel heat exchangers 50-21 and 50-22) through the defrosting circuit, and in the other one or more heat source units (for example, the heat source unit A-1) among the plurality of heat source units, continuing heating by allowing all the plurality of parallel heat exchangers (for example, the parallel heat exchangers 50-11 and 50-12) to operate as evaporators so that a suction pressure of the compressor 1-2 in each of the one or some heat source units (for example, the heat source unit A-2) is higher than a suction pressure of the compressor 1-1 in each of the other one or more heat source units (for example, the heat source unit A-1).

With this configuration, an operation for acquiring a higher heating capacity can be selected to be performed from the first simultaneous heating and defrosting operation and the second simultaneous heating and defrosting operation. Thus, a decrease in heating capacity in a simultaneous heating and defrosting operation can be suppressed.

In the refrigeration cycle apparatus according to Embodiments described above, the controller 30 may select, based on an outdoor air temperature, any one of the first simultaneous heating and defrosting operation and the second simultaneous heating and defrosting operation. In the refrigeration cycle apparatus according to Embodiments described above, the controller 30 may select the first simultaneous heating and defrosting operation when the outdoor air temperature is equal to or higher than a threshold temperature set in advance and may select the second simultaneous heating and defrosting operation when the outdoor air temperature is lower than the threshold temperature.

With this configuration, a highly efficient simultaneous heating and defrosting operation can be selected based on an outdoor air temperature, and hence a decrease in heating capacity in a simultaneous heating and defrosting operation can be suppressed more reliably.

In the refrigeration cycle apparatus according to Embodiments described above, each of the plurality of heat source units A-1 and A-2 may further include the first expansion device (for example, the first expansion device 10-1) provided in the defrosting circuit (for example, the defrosting pipe 15-1) and configured to decompress the refrigerant discharged from the compressor before the refrigerant is supplied to the at least one or some parallel heat exchangers, and the second expansion device (for example, the second expansion device 7-13) configured to further decompress the refrigerant having flowed out of the one or some parallel heat exchangers before the refrigerant returns to the main circuit in the first simultaneous heating and defrosting operation.

In the refrigeration cycle apparatus according to Embodiments described above, in both the first simultaneous heating and defrosting operation and the second simultaneous heating and defrosting operation, the refrigerant discharged from the compressor may flow through the first expansion device into the parallel heat exchanger to be defrosted. In addition, as the first expansion device and the second expansion device, capillary tubes in which control of the opening degree is not necessary, or compact solenoid valves may be used by designing a flow passage resistance in advance so that a flow rate and a pressure of defrosting becomes predetermined values by limiting a range of an outdoor air temperature in which a simultaneous heating and defrosting operation can be performed.

In the refrigeration cycle apparatus according to Embodiments described above, in the second simultaneous heating and defrosting operation, the defrosting circuit of each of the one or some heat source units (for example, the heat source unit A-2) may be disconnected from the main circuit of each of the other one or more heat source units (for example, the heat source unit A-1) by the check valve (for example, the check valve 16-2) and the first flow switching device (for example, the second expansion devices 7-22 and 7-23), and in the second simultaneous heating and defrosting operation, the refrigerant discharged from the compressor of each of the one or some heat source units may be supplied to all the parallel heat exchangers (for example, the parallel heat exchangers 50-21 and 50-22 connected in series) after being decompressed by the first expansion device (for example, the first expansion device 10-2).

In the refrigeration cycle apparatus according to Embodiments described above, in the second simultaneous heating and defrosting operation, the controller 30 may perform control so that a discharge pressure of the compressor of each of the one or some heat source units (for example, the heat source unit A-2) is lower than a discharge pressure of the compressor of each of the other one or more heat source units (for example, the heat source unit A-1).

The first flow switching device may include the second expansion device (for example, the second expansion device 7-23), and in the second simultaneous heating and defrosting operation, the second expansion device may be closed.

In the refrigeration cycle apparatus according to Embodiments described above, in the second simultaneous heating and defrosting operation, the controller 30 may perform, when a suction superheat of the compressor of each of the one or some heat source units (for example, the heat source unit A-2) becomes larger than a threshold set in advance, control to return liquid refrigerant from the main circuit of each of the other one or more heat source units (for example, the heat source unit A-1) to the defrosting circuit of each of the one or some heat source units (for example, the heat source unit A-2).

In the refrigeration cycle apparatus according to Embodiments described above, the main circuit is connected to a plurality of indoor units B and C which are capable of selecting a heating operation or a cooling operation. Gas-side pipes (for example, the first extension pipes 11-2*b* and 11-2*c*) connected to the plurality of indoor units B and C are connected to both the discharge pipes 1*a*-1 and 1*a*-2 and the suction pipes 1*b*-1 and 1*b*-2 of the compressors 1-1 and 1-2 through a second flow switching device (for example, the switching valves 25-1*b*, 25-1*c*, 25-2*b*, and 25-2*c*). The second flow switching device switches a flow passage so that high-pressure refrigerant discharged from the compressors 1-1 and 1-2 through the discharge pipes 1*a*-1 and 1*a*-2 flows into a gas-side pipe connected to an indoor unit that selects the heating operation among the plurality of indoor units B and C, and that low-pressure refrigerant to be sucked by the compressors 1-1 and 1-2 through the suction pipes 1*b*-1 and 1*b*-2 flows into a gas-side pipe connected to an indoor unit that selects the cooling operation among the plurality of indoor units B and C. When the controller 30 determines that defrosting of the plurality of parallel heat exchangers needs to be performed during the simultaneous cooling and heating operation (for example, the heating main operation) in which the indoor unit that selects the heating operation and the indoor unit that selects the cooling operation are present, the controller 30 may perform the first simultaneous heating and defrosting operation or the second simultaneous heating and defrosting operation while continuing the simultaneous cooling and heating operation.

Other Embodiments

The present invention is not limited to Embodiments described above, and various modifications can be carried out.

For example, in Embodiments described above, the air-conditioning apparatuses 100, 101, and 102 capable of performing both cooling and heating are described as examples, but the present invention can be applied to any air-conditioning apparatus capable of performing at least heating.

In Embodiments described above, the air-conditioning apparatuses 100, 101, and 102 including a refrigeration cycle apparatus have been described as examples, but the present invention is not limited thereto. A refrigeration cycle apparatus according to the present invention can be used in, for example, other apparatuses such as a refrigerator or a freezer.

In Embodiments described above, a configuration in which each of the outdoor heat exchangers 5-1 and 5-2 includes two parallel heat exchangers has been described as an example, but the outdoor heat exchanger may include three or more parallel heat exchangers. Now, description is made of an exemplary configuration in which the outdoor heat exchanger 5-1 of the heat source unit A-1 of Embodiment 1 includes four parallel heat exchangers.

Figure 24:
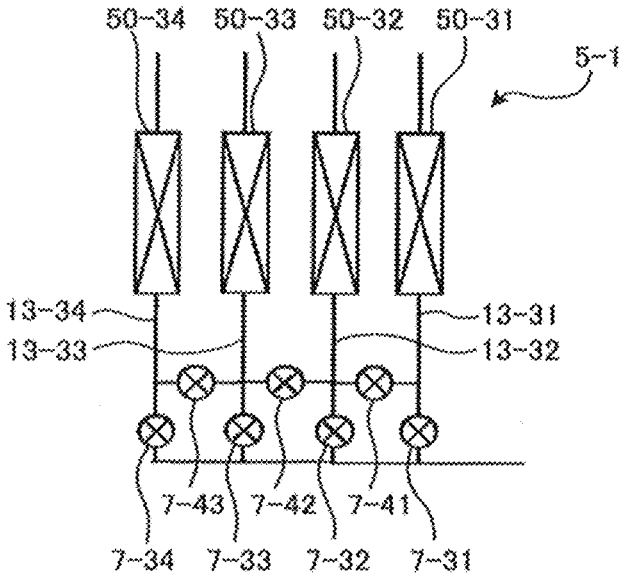
FIG. 24 is a diagram for illustrating a modification example of the configuration of the heat source unit A-1 of Embodiment 1 of the present invention.

FIG. 24 is a diagram for illustrating a modification example of the configuration of the heat source unit A-1 of Embodiment 1 described above. FIG. 24 is an illustration of only the circuit configuration of the outdoor heat exchanger 5-1 of the heat source unit A-1 and the vicinity thereof. As illustrated in FIG. 24, the outdoor heat exchanger 5-1 of this example includes four parallel heat exchangers 50-31, 50-32, 50-33, and 50-34. The parallel heat exchangers 50-31, 50-32, 50-33, and 50-34 are connected in parallel to one another in a refrigerant circuit. The parallel heat exchangers 50-31, 50-32, 50-33, and 50-34 are connected to first connection pipes 13-31, 13-32, 13-33, and 13-34, respectively. The first connection pipes 13-31, 13-32, 13-33, and 13-34 are provided with second expansion devices 7-31, 7-32, 7-33, and 7-34, respectively. When the first connection pipes 13-31, 13-32, 13-33, and 13-34 are arranged in the positional relationship illustrated in FIG. 24, the first connection pipes adjacent to each other are connected to each other through a bypass pipe. The connection position of the bypass pipe in each first connection pipe is between the second expansion device and the parallel heat exchanger. The bypass pipes are respectively provided with second expansion devices 7-41, 7-42, and 7-43.

In this way, when an outdoor heat exchanger includes n (an integer of 2 or more) parallel heat exchangers, (n−1) bypass pipes and (n−1) second expansion devices are provided. With this configuration, whichever parallel heat exchanger is subjected to defrosting, the refrigerant having flowed out of the parallel heat exchanger subjected to defrosting can be allowed to flow into a parallel heat exchanger other than the parallel heat exchanger subjected to defrosting (a parallel heat exchanger operating as an evaporator). Accordingly, in the simultaneous heating and defrosting operation 1, the n parallel heat exchangers can be defrosted one by one.

The embodiments and modification examples described above can be carried out in combination.

REFERENCE SIGNS LIST

1-1, 1-2 compressor 1*a*-1, 1*a*-2 discharge pipe 1*b*-1, 1*b*-2 suction pipe 2-1, 2-2 cooling/heating switching device 3-*b*, 3-*c* indoor heat exchanger 3*f*-*b*, 3*f*-*c* indoor fan 4-*b*, 4-*c* flow rate control device 5-1, 5-2 outdoor heat exchanger 5*a* heat transfer pipe 5*b* fin 5*f*-1, 5*f*-2 outdoor fan 6-1, 6-2 accumulator 7-11, 7-12, 7-13, 7-21, 7-22, 7-23, 7-31, 7-32, 7-33, 7-34, 7-41, 7-42, 7-43 second expansion device 8-11, 8-12, 8-21, 8-22 first solenoid valve 9-11, 9-12, 9-21, 9-22 second solenoid valve 10-1, 10-2 first expansion device 11-1, 11-1H, 11-1L, 11-2*b*, 11-2*c* first extension pipe 12-1, 12-2*b*, 12-2*c* second extension pipe 13-11, 13-12, 13-21, 13-22, 13-31, 13-32, 13-33, 13-34 first connection pipe 14-11, 14-12, 14-21, 14-22 second connection pipe 15-1, 15-2 defrosting pipe 16-1, 16-2, 16-1*a*, 16-1*b*, 16-1*c*, 16-1*d*, 16-2*a*, 16-2*b*, 16-2*c*, 16-2*d* check valve 18-11, 18-12, 18-21, 18-22 third solenoid valve 20-1, 20-2 defrosting pipe 21-11, 21-12, 21-21, 21-22 pressure sensor 22-11, 22-12, 22-13, 22-14, 22-21, 22-22, 22-23, 22-24, 23 temperature sensor 24-11, 24-12, 24-21, 24-22 check valve 25-1*b*, 25-1*c*, 25-2*b*,

25-2*c* switching valve 26-1 third expansion device 26-2 fourth expansion device 30 controller 31 selecting unit 32 determining unit 50-11, 50-12, 50-21, 50-22, 50-31, 50-32, 50-33, 50-34 parallel heat exchanger 100, 101, 102, 103, 104 air-conditioning apparatus A-1, A-2 heat source unit B, C indoor unit D relay unit E-1 first branch portion E-2 second branch portion E-3 third branch portion

The invention claimed is:

1. A refrigeration cycle apparatus, comprising:

a main circuit configured to circulate refrigerant;

a plurality of heat source units connected in parallel to each other in the main circuit; and a controller configured to control the plurality of heat source units, each of the plurality of heat source units including:

a compressor configured to compress and discharge refrigerant;

a plurality of parallel heat exchangers connected in parallel to each other in a flow of refrigerant and configured to operate at least as evaporators;

a check valve configured to prevent backflow of the refrigerant discharged from the compressor;

a defrosting circuit configured to branch the refrigerant discharged from the compressor on an upstream side of the check valve and supply the refrigerant to at least one or some parallel heat exchangers among the plurality of parallel heat exchangers; and a first flow switching device configured to switch a flow passage of refrigerant passing through the plurality of parallel heat exchangers, wherein the controller is configured to switch between and perform a first simultaneous heating and defrosting operation of, in at least one or some heat source units among the plurality of heat source units, supplying part of the refrigerant discharged from the compressor to the one or some parallel heat exchangers among the plurality of parallel heat exchangers through the defrosting circuit and allowing the other one or more parallel heat exchangers among the plurality of parallel heat exchangers to operate as evaporators, and a second simultaneous heating and defrosting operation of, in one or some heat source units among the plurality of heat source units, supplying the refrigerant discharged from the compressor to all the plurality of parallel heat exchangers through the defrosting circuit, and in the other one or more heat source units among the plurality of heat source units, continuing heating by allowing all the plurality of parallel heat exchangers to operate as evaporators, and operating the plurality of the heat source units so that a suction pressure of the compressor in each of the one or some heat source units among the plurality of heat source units is higher than a suction pressure of the compressor in each of the other one or more heat source units among the plurality of heat source units.

2. The refrigeration cycle apparatus of claim 1, wherein the controller is configured to select, based on an outdoor air temperature, any one of the first simultaneous heating and defrosting operation and the second simultaneous heating and defrosting operation.

3. The refrigeration cycle apparatus of claim 2, wherein the controller is configured to select the first simultaneous heating and defrosting operation when the outdoor air temperature is equal to or higher than a threshold temperature set in advance, and select the second simultaneous heating and defrosting operation when the outdoor air temperature is lower than the threshold temperature.

4. The refrigeration cycle apparatus of claim 1, wherein each of the plurality of heat source units, further includes a first expansion device provided in the defrosting circuit and configured to decompress the refrigerant discharged from the compressor before the refrigerant is supplied to the at least one or some parallel heat exchangers; and a second expansion device configured to further decompress the refrigerant having flowed out of the one or some parallel heat exchangers before the refrigerant returns to the main circuit in the first simultaneous heating and defrosting operation.

5. The refrigeration cycle apparatus of claim 4, wherein, in both the first simultaneous heating and defrosting operation and the second simultaneous heating and defrosting operation, the refrigerant discharged from the compressor flows through the first expansion device into the parallel heat exchanger to be defrosted among the plurality of parallel heat exchangers.

6. The refrigeration cycle apparatus of claim 4, wherein, in the second simultaneous heating and defrosting operation, the defrosting circuit of each of the one or some heat source units is disconnected from the main circuit of each of the other one or more heat source units by the check valve and the first flow switching device, and wherein, in the second simultaneous heating and defrosting operation, the refrigerant discharged from the compressor of each of the one or some heat source units is supplied to all the parallel heat exchangers after being decompressed by the first expansion device.

7. The refrigeration cycle apparatus of claim 6, wherein, the controller is configured to, in the second simultaneous heating and defrosting operation, control the plurality of heat source units so that a discharge pressure of the compressor of each of the one or some heat source units is lower than a discharge pressure of the compressor of each of the other one or more heat source units.

8. The refrigeration cycle apparatus of claim 6, wherein the first flow switching device includes the second expansion device, and wherein, in the second simultaneous heating and defrosting operation, the second expansion device is closed.

9. The refrigeration cycle apparatus of claim 6, wherein the controller is configured to, in the second simultaneous heating and defrosting operation, when a suction superheat of the compressor of the each of the one or some heat source units becomes larger than a threshold set in advance, perform control to return liquid refrigerant from the main circuit of each of the other one or more heat source units to the defrosting circuit of each of the one or some heat source units.

10. The refrigeration cycle apparatus of claim 1, wherein the main circuit is connected to a plurality of indoor units which are capable of selecting from a heating operation and a cooling operation, wherein gas-side pipes connected to the plurality of indoor units are connected to both a discharge pipe and a suction pipe of the compressor through a second flow switching device, wherein the second flow switching device switches a flow passage so that high-pressure refrigerant discharged from the compressor through the discharge pipe flows into a gas-side pipe connected to an indoor unit that selects the heating operation among the plurality of indoor units, and that low-pressure refrigerant to be sucked by the compressor through the suction pipe flows into a gas-side pipe connected to an indoor unit that selects the cooling operation among the plurality of indoor units, and wherein, the controller is configured to, when determining that defrosting of the plurality of parallel heat exchangers needs to be performed during a simultaneous cooling and heating operation in which the indoor unit that selects the heating operation and the indoor unit that selects the cooling operation are present, perform the first simultaneous heating and defrosting operation or the second simultaneous heating and defrosting operation while continuing the simultaneous cooling and heating operation.

* * * * *